US010962917B2

(12) United States Patent
Sako et al.

(10) Patent No.: US 10,962,917 B2
(45) Date of Patent: Mar. 30, 2021

(54) IMAGE HEATING DEVICE AND IMAGE FORMING APPARATUS

(71) Applicant: CANON KABUSHIKI KAISHA, Tokyo (JP)

(72) Inventors: Masato Sako, Mishima (JP); Hideaki Yonekubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/830,355

(22) Filed: Mar. 26, 2020

(65) Prior Publication Data

US 2020/0310328 A1 Oct. 1, 2020

(30) Foreign Application Priority Data

Mar. 28, 2019 (JP) ..... JP2019-063327

(51) Int. Cl.
*G03G 15/00* (2006.01)
*G03G 15/20* (2006.01)

(52) U.S. Cl.
CPC ..... *G03G 15/80* (2013.01); *G03G 15/2053* (2013.01)

(58) Field of Classification Search
CPC ..... G03G 15/80; G03G 15/2053; G03G 15/2039; G03G 15/2046
See application file for complete search history.

(56) References Cited

U.S. PATENT DOCUMENTS

2014/0219696 A1* 8/2014 Fujimoto ..... G03G 15/2042 399/334
2018/0032008 A1* 2/2018 Sako ..... G03G 15/80

FOREIGN PATENT DOCUMENTS

JP 2011018027 A 1/2011
JP 2014059508 A 4/2014
JP 2018017910 A 2/2018
JP 2019032356 A 2/2019

* cited by examiner

*Primary Examiner* — Sandra Brase
(74) *Attorney, Agent, or Firm* — Venable LLP

(57) ABSTRACT

An image heating device has a paper-passing heating region in which a recording material passes through at least a part of a heating region and a non-paper-passing heating region in which the recording material does not pass through the heating region, and changes a heating amount applied to a fixing member in the non-paper-passing heating region in accordance with a longitudinal distance between a boundary position between the paper-passing heating region and the non-paper-passing heating region in the longitudinal direction and the boundary position side end portion of the recording material in the paper-passing heating region.

6 Claims, 21 Drawing Sheets

IMAGE HEATING DEVICE AND IMAGE FORMING APPARATUS

BACKGROUND OF THE INVENTION

Field of the Invention

The present invention relates to a fixing device to be mounted on an electrophotographic image forming apparatus such as a copying machine or a printer, or to a gloss-imparting device that increases the gloss of a toner image by reheating the fixed toner image on a recording material, and the like.

Description of the Related Art

An image heating device having a cylindrical film, a heater that comes into contact with an inner surface of the film, and a roller for forming, together with the heater, a nip N through the film is known as a fixing device provided in an image forming apparatus using an electrophotographic method, an electrostatic recording method, or the like. In an image forming apparatus equipped with such image heating device, where an image is continuously formed on a recording material having a size smaller than the maximum paper-passable width in a direction orthogonal to the conveyance direction of the recording material (hereinafter, referred to as small-size paper), a so-called non-paper-passing portion temperature rise occurs. That is, a phenomenon occurs such that the temperature of parts in a region where the paper does not pass (non-paper-passing portion) in the longitudinal direction of the nip N orthogonal to the conveyance direction of the recording material gradually rises. The image heating device needs to be configured such that the temperature of the non-paper-passing portion does not exceed the heat resistance temperature of each member in the device. For this reason, a method of suppressing the non-paper-passing portion temperature rise by reducing the throughput (hereinafter, referred to as throughput reduction) of continuous printing (the number of prints that can be made per minute) is often used.

By contrast, Japanese Patent Application Publication No. 2014-59508 discloses a method for suppressing a temperature rise in a non-paper-passing portion without causing a decrease in throughput. In this method, heating resistors each composed of a set of a conductor and a heating element are arranged separately in the longitudinal direction of the nip, and power supplied to the heating resistors is independently controlled for each of a plurality of heating regions arranged in the longitudinal direction of the nip. By not supplying, except when necessary, electric power to the heating resistor that heats the heating region through which the recording material does not pass (non-paper-passing heating region), the non-paper-passing portion temperature rise can be suppressed.

Further, Japanese Patent Application Publication No. 2018-17910 discloses a method in which the amount of power supplied to a non-paper-passing heating region adjacent to a heating region through which a recording material passes (paper-passing heating region) is set lower than that of a paper-passing heating region and also lower than that of another non-paper-passing heating region located further outside the aforementioned non-paper-passing heating region. According to this method, when printing on a recording material having a larger width (hereinafter, referred to as a large-size paper) after a small-size paper, the waiting time for leveling the uneven temperature distribution in the longitudinal direction generated when the small-size paper was printed can be reduced.

When a large amount of small-size paper of a specific size is printed (hereinafter, referred to as a small-size continuous paper-passing job), lowering the amount of power supply to the non-paper-passing heating region, as disclosed in Japanese Patent Application Publication No. 2014-59508 and Japanese Patent Application Publication No. 2018-17910, can shorten the total printing time.

SUMMARY OF THE INVENTION

However, since the combination of the recording material size and the number of prints differs depending on the use by the user, it is not always optimal to lower the power supply amount to the non-paper-passing heating region just because small-size paper is printed.

For example, in a case where small-size and large-size prints are alternately and repeatedly (for example, every other sheet) printed at a relatively short interval (hereinafter, referred to as a small-size/large-size mixed job), the non-paper-passing portion temperature rise hardly occurs when printing small-size paper. Therefore, where the amount of power supply to the non-paper-passing heating region is not reduced, the total printing time is short because there is no waiting time for the temperature to rise to the level required for the next large-size printing.

An object of the present invention is to shorten the total printing time on a recording material in the case of a small-size/large-size mixed job.

To achieve the above object, the image heating device of the present invention includes:

a heating unit including a heater for heating an image formed on a recording material, wherein the heater includes a substrate and a plurality of heating resistors provided on the substrate so as to be separated in a direction orthogonal to a conveyance direction of the recording material;

a cylindrical film that is in contact with the heating unit by an inner surface thereof;

a pressing member that comes into contact with an outer surface of the film to form a nip portion that conveys the recording material between the outer surface of the film and the pressing member; and a control portion that controls electric power supplied to the plurality of heating resistors, wherein, when a small size recording material passes the nip portion, a plurality of heating regions in the nip portion heated by the plurality of heating resistors includes a paper-passing heating region through which the recording material passes, and a non-paper-passing heating region through which the recording material does not pass, wherein the control portion has a first control mode in which power is supplied at a first power to a heating resistor among the plurality of heating resistors for heating the paper-passing heating region, and power is supplied at a second power to a heating resistor among the plurality of heating resistors for heating the non-paper-passing heating region, the second power being less than the first power, and a second control mode in which power is supplied at the first power to the heating resistor among the plurality of heating resistors for heating the paper-passing heating region, and power is supplied at a third power to the heating resistor among the plurality of heating resistors for heating the non-paper-passing heating region, the third power being less than the second power, and wherein the control portion switches between the first control mode and the second control mode based on a distance between a boundary position between the paper-passing heating region and the non-paper-passing heating region and a position of a boundary position side end portion of the recording material in the paper-passing heating region in the direction orthogonal to the conveyance direction of the recording material.

To achieve the above object, the image forming apparatus of the present invention includes:

an image forming portion that forms an image on a recording material; and a fixing portion that fixes the image formed on the recording material to the recording material, wherein the fixing portion is an image heating device, wherein the image heating device includes:

a heating unit including a heater for heating an image formed on the recording material, wherein the heater includes a substrate and a plurality of heating resistors provided on the substrate so as to be separated in a direction orthogonal to a conveyance direction of the recording material;

a cylindrical film that is in contact with the heating unit by an inner surface thereof;

a pressing member that comes into contact with an outer surface of the film to form a nip portion that conveys the recording material between the outer surface of the film and the pressing member; and a control portion that controls electric power supplied to the plurality of heating resistors, wherein, when a small-size recording material passes the nip portion, a plurality of heating regions in the nip portion heated by the plurality of heating resistors includes a paper-passing heating region through which the recording material passes, and a non-paper-passing heating region through which the recording material does not pass, wherein the control portion has a first control mode in which power is supplied at a first power to a heating resistor among the plurality of heating resistors for heating the paper-passing heating region, and power is supplied at a second power to a heating resistor among the plurality of heating resistors for heating the non-paper-passing heating region, the second power being less than the first power, and a second control mode in which power is supplied at the first power to the heating resistor among the plurality of heating resistors for heating the paper-passing heating region, and power is supplied at a third power to the heating resistor among the plurality of heating resistors for heating the non-paper-passing heating region, the third power being less than the second power, and wherein the control portion switches between the first control mode and the second control mode based on a distance between a boundary position between the paper-passing heating region and the non-paper-passing heating region and a position of a boundary position side end portion of the recording material in the paper-passing heating region in the direction orthogonal to the conveyance direction of the recording material.

According to the present invention, it is possible to shorten the total printing time on a recording material in the case of a small-size/large-size mixed job.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Description of Image Forming Apparatus in Embodiment 1

Figure 1:
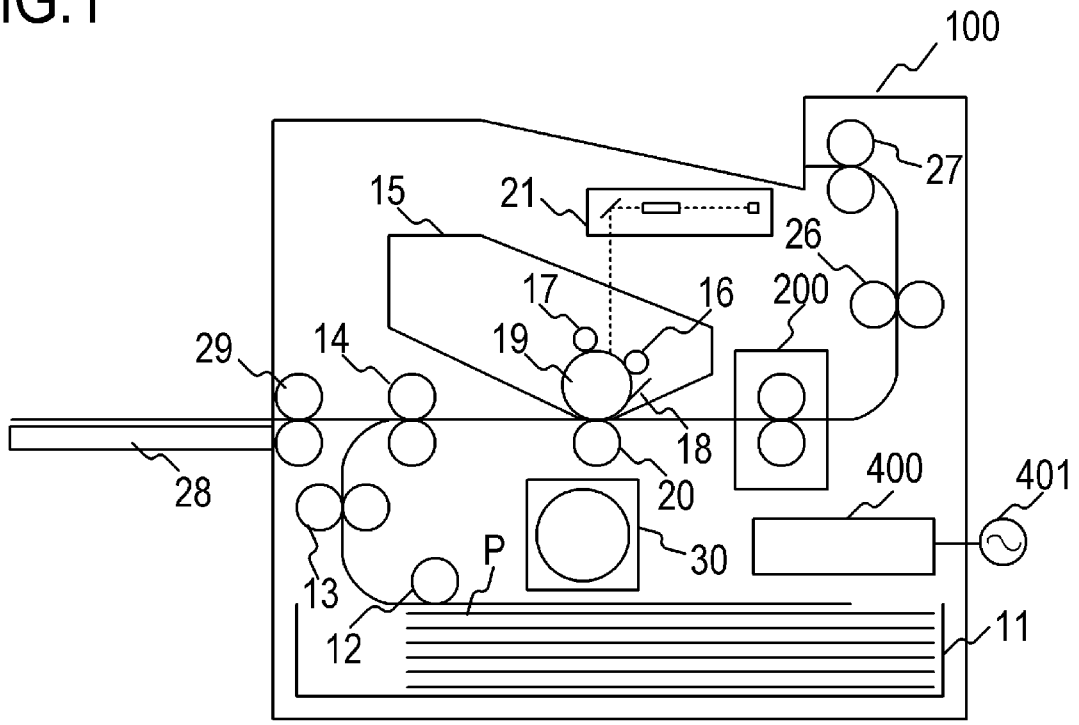
FIG. 1 is an explanatory diagram of an image forming apparatus according to an embodiment of the present invention.

FIG. 1 is a schematic sectional view of an image forming apparatus 100 using electrophotographic recording. Examples of the image forming apparatus to which the present invention is applicable include a copying machine, a printer and the like using an electrophotographic method or an electrostatic recording method. Here, a case is described in which the present invention is applied to a laser printer in which an image is formed on a recording material P by using the electrophotographic method.

Where a print signal is generated, a scanner unit 21 emits a laser beam modulated according to image information, and scans a photosensitive member (photosensitive drum) 19 charged to a predetermined polarity by a charging roller 16. As a result, an electrostatic latent image is formed on the photosensitive member 19. Then, a toner is supplied from a developing device (developing roller 17) to the electrostatic latent image, and a toner image corresponding to the image information is formed on the photosensitive member 19. The photosensitive member 19, the charging roller 16, and the developing device 17 are integrated as a process cartridge 15 including a toner storage chamber, and are configured to be detachable from a main body of the image forming apparatus 100. Meanwhile, the recording paper P as a recording material loaded on a paper feed cassette 11 is fed one by one by a pickup roller 12 and is conveyed toward registration rollers 14 by rollers 13. Further, the recording material P is conveyed from the registration rollers 14 to a transfer position, which is formed by the photosensitive member 19 and a transfer roller 20, at a timing when the toner image on the photosensitive member 19 reaches the transfer position. As the recording material P passes through the transfer position, the toner image on the photosensitive member 19 is transferred to the recording material P. Thereafter, the recording material P is heated by a fixing device (image heating device) 200 as a fixing portion (image heating portion) in the image forming apparatus, and the toner image is heated and fixed on the recording material P. The recording material P carrying the fixed toner image is discharged to a tray on the top of the image forming apparatus 100 by rollers 26, 27. A cleaner 18 cleans toner remaining on the photosensitive member 19. A paper feed tray 28 (manual tray) having a pair of recording material regulating plates adjustable in width according to the size of the recording material P is provided to accommodate recording materials P of sizes other than the standard size. The pickup roller 29 feeds the recording material P from the paper feed tray 28. The image forming apparatus 100 includes a motor 30 that drives the fixing device 200 and the like. Power is supplied to the fixing device 200 from a control circuit 400 as a control means (control portion) connected to a commercial AC power source 401. The above-described photosensitive member 19, charging roller 16, scanner unit 21, developing device 17, and transfer roller 20 constitute an image forming portion that forms an unfixed image on the recording material P.

The image forming apparatus 100 according to Embodiment 1 supports a plurality of recording material sizes. In the paper feed cassette 11, Letter paper (215.9 mm×279.4 mm), Legal paper (215.9 mm×355.6 mm), A4 paper (210 mm×297 mm), and 16K paper (195 mm×270 mm) can be set. Executive paper (184.15 mm×266.7 mm), B5 paper (182 mm×257 mm), and A5 paper (148 mm×210 mm) can be also set. Further, from the paper feed tray 28, fixed-size paper such as A6 paper (105 mm×148 mm) and B6 paper (128 mm×182 mm) and irregular-size paper such as DL envelope (110 mm×220 mm) and COM10 envelope (104.77 mm×241.3 mm) can be fed for printing. The image forming apparatus 100 according to Embodiment 1 is basically a laser printer in which paper is fed vertically (the recording material is conveyed so that the long side of the recording material is parallel to the conveyance direction). Among the widths of the recording material that can be printed by the image forming apparatus 100 according to Embodiment 1 (hereinafter, referred to as paper width), the largest paper width is 215.9 mm, and the smallest paper width is 76.2 mm.

The process speed of the image forming apparatus 100 in Embodiment 1 is 330 mm/s, and the distance from the rear end of the recording material on which an image has been formed to the front end of the next recording material on which the next image is to be formed (hereinafter, referred to as a paper interval) is usually 50 mm. The throughput at the time of continuous printing at a typical recording material size is shown in Table 1. The unit of the throughput is page per minute (ppm), and a value obtained by rounding down the decimal point is indicated.

TABLE 1

| Recording material size | Throughput[ppm] |
|---|---|
| LTR | 60 |
| LGL | 48 |
| A4 | 57 |
| 16K | 61 |
| B5 | 64 |
| A5 | 76 |
| B6 | 85 |
| A6 | 100 |
| DL envelope | 73 |
| COM10 | 67 |

Description of Image Heating Device in Embodiment 1

Figure 2:
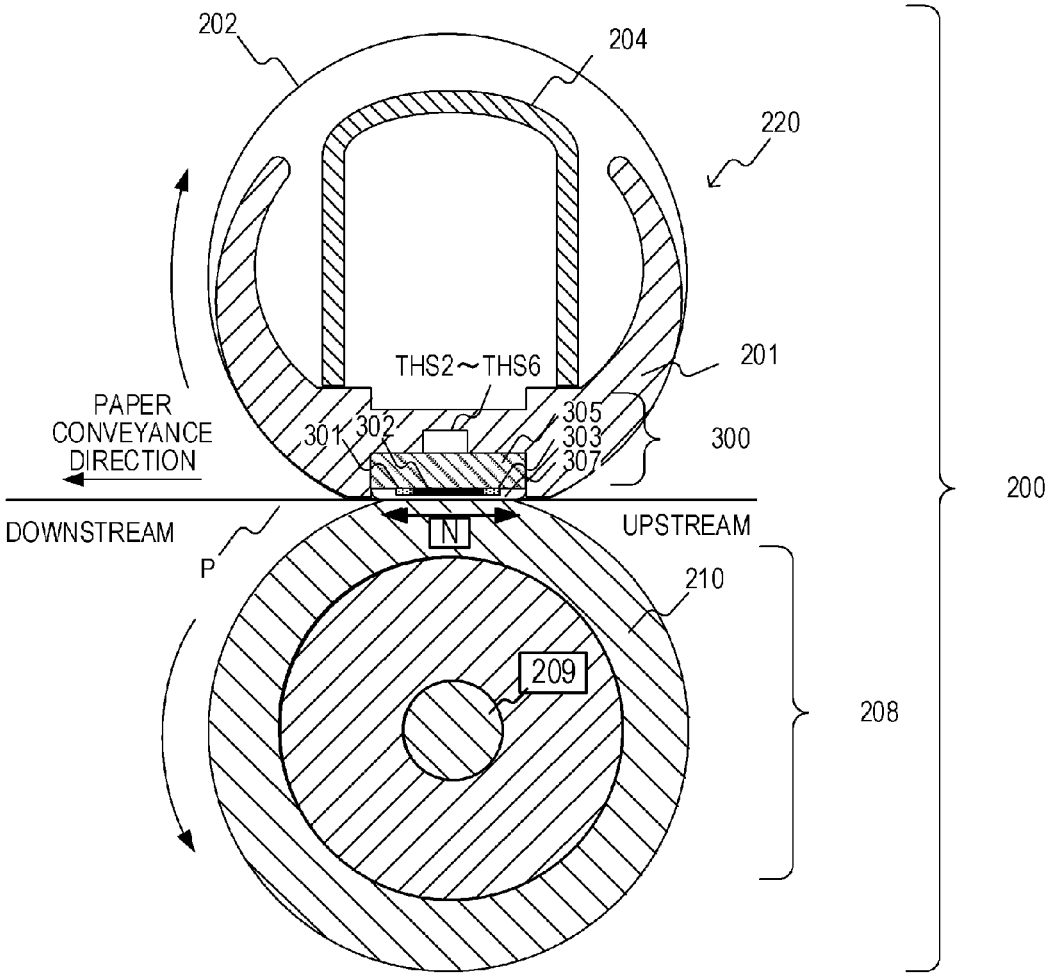
FIG. 2 is a cross-sectional view of the fixing device according to Embodiment 1.

FIG. 2 is a cross-sectional view of the fixing device 200 according to the present embodiment. The fixing device 200 includes a cylindrical fixing film (hereinafter, referred to as a film) 202 as a fixing member, a heater 300, and a pressure roller 208 as a pressing member opposed to the heater 300 with the film 202 being interposed therebetween. The configurations of the film 202, the heater 300, the pressure roller 208, and the like related to the heating of the image formed on the recording material correspond to the image heating device in the present invention. A fixing nip (nip portion) N is formed between the outer surface of the film 202 and the pressure roller 208 in a portion where the heater 300 and the pressure roller 208 face each other.

The material of a base layer of the film 202 is a heat-resistant resin such as a polyimide or a metal such as stainless steel. Further, an elastic layer such as heat-resistant rubber may be provided on the surface layer of the film 202. A lubricant (not shown) is applied to the inner contact surfaces of the film 202 and the heater 300 in order to improve slidability between the two. The lubricant is softened by the heat applied from the heater 300, and has an effect of reducing the torque applied to the film 202 and the heater 300.

The pressure roller 208 has a metal core 209 made of a material such as iron or aluminum, and an elastic layer 210 made of silicone rubber or the like. The pressure roller 208 receives drive power from the motor 30 and rotates in a direction indicated by an arrow in FIG. 2. The film 202 rotates following the rotation of the pressure roller 208. The recording material P carrying the unfixed toner image is heated using the heat of the heater 300 while being nipped and conveyed by the fixing nip N, and is subjected to a fixing process.

The heater 300 has a configuration in which a conductor 301, a conductor 303, and a heating resistor 302 as heating portion are provided on a ceramic substrate 305. The conductor 301 is provided as a conductor A on the substrate 305 along the longitudinal direction of the heater. The conductor 303 is provided as a conductor B along the longitudinal direction of the heater at a position different from that of the conductor 301 in the heater lateral direction. The heating resistor 302 has a positive temperature coefficient of resistance (hereinafter, referred to as temperature coefficient rate (TCR)) as a heating element, and is provided between the conductor 301 and the conductor 303. The heater 300 further has an insulating (glass in Embodiment 1) surface protective layer 307 that covers the heating resistor 302, the conductor 301, and the conductor 303 described above. Thermistors THS2 to THS6, which serve as temperature detecting elements for detecting a non-paper-passing portion temperature rise when printing small-size paper, are in contact with the rear side of the heater substrate 305.

A holding member 201 is made of a heat-resistant resin, and has a function of holding the heater 300 and a guide function of guiding the rotation of the film 202. A stay 204 is a metal stay for applying the pressure of a spring (not shown) to the holding member 201. A heating unit 220 being in contact with an inner surface of the film 202 includes the heater 300, the holding member 201, and the metal stay 204.

Figure 3:
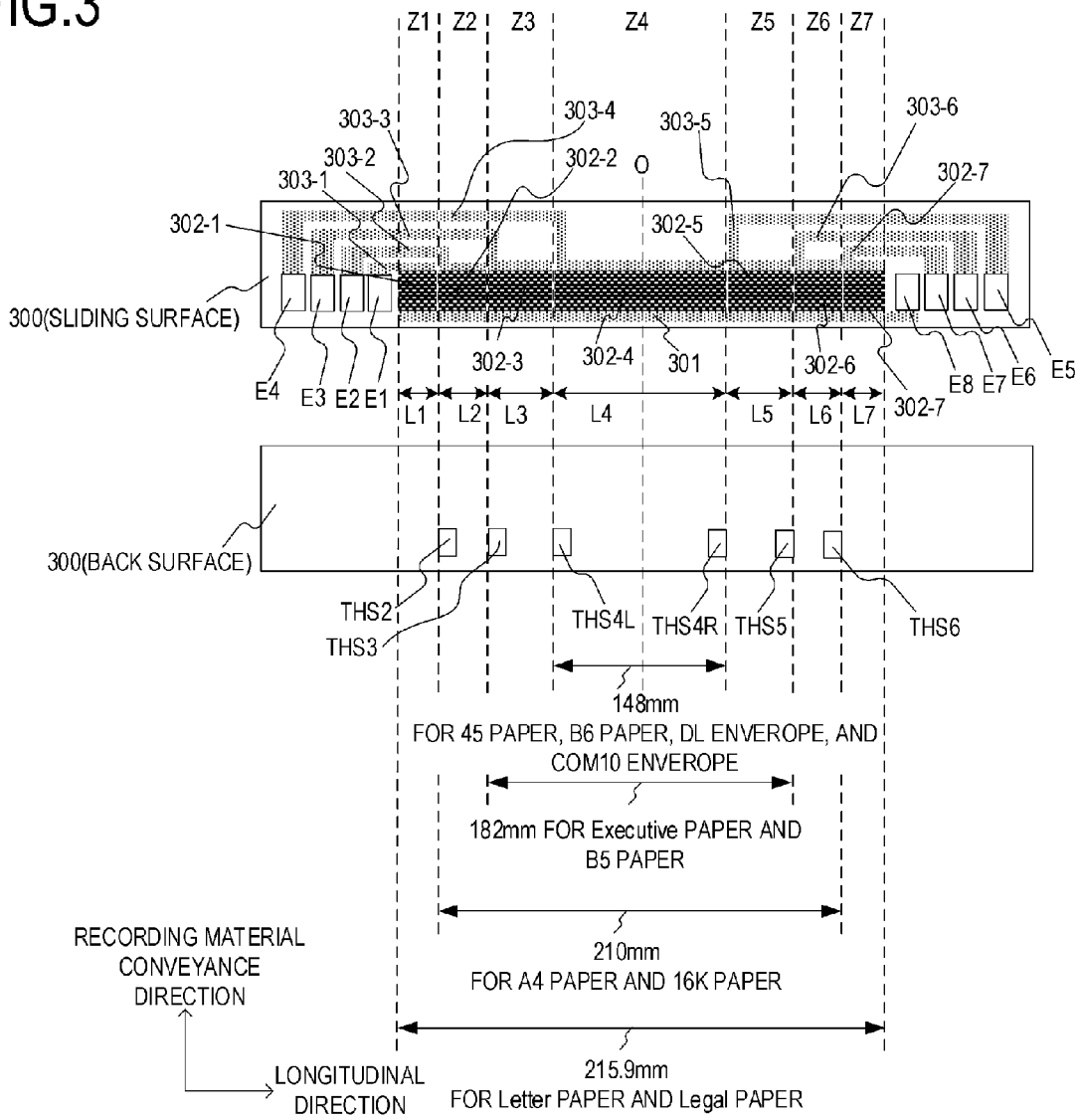
FIG. 3 is a heater configuration diagram of Embodiment 1.

FIG. 3 shows a configuration diagram of the heater 300 according to Embodiment 1. A reference position for conveying different types of paper is defined as a recording material (paper) conveyance reference position O.

The heater 300 includes a heating region Z1, a heating region Z2, a heating region Z3, a heating region Z4, a heating region Z5, a heating region Z6, and a heating region Z7. The heating resistor 302 of the heater 300 is present in each of the aforementioned heating regions. A heating resistor 302-1 corresponds to the heating region Z1, a heating resistor 302-2 corresponds to the heating region Z2, a heating resistor 302-3 corresponds to the heating region Z3, and a heating resistor 302-4 corresponds to the heating region Z4. Further, a heating resistor 302-5 corresponds to the heating region Z5, a heating resistor 302-6 corresponds to the heating region Z6, and a heating resistor 302-7 corresponds to the heating region Z7.

The width (L4), in the longitudinal direction of the heater, of the heating resistor 302-4 for heating the heating region Z4 is 148 mm, which corresponds to the width of A5 paper. The overall longitudinal width (L3+L4+L5) of the heating resistors 302-3 to 302-5 for heating the three central heating regions Z3, Z4, and Z5 in the longitudinal direction of the heater is 182 mm, which corresponds to the width of B5 paper. The overall width (L2+L3+L4+L5+L6), in the longitudinal direction of the heater, of the heating resistors 302-2 to 302-6 for heating the five central heating regions Z2, Z3, Z4, Z5, and Z6 in the longitudinal direction of the heater is 210 mm, which corresponds to the width of A4 paper. The width (L1+L2+L3+L4+L5+L6+L7), in the longitudinal direction of the heater, of all the heating resistors 302-1 to 302-7 for heating the seven heating regions is 215.9 mm, which corresponds to the width of Letter paper. The conductor 301 is provided along the seven heating resistors 302-1 to 302-7. Meanwhile, the conductor 303 is divided into seven conductors 303-1 to 303-7, each of which is provided correspondingly to the heating resistors 302-1 to 302-7. E1, E2, E3, E4, E5, E6, E7, and E8 are electrodes used to supply power to the heater 300.

Thermistors THS2, THS3, THS4L, THS4R, THS5, and THS6 are in contact with the back surface of the heater 300. The thermistors THS2, THS3, and THS4L detect the left end temperatures of the heating resistors 302-2, 302-3, and 302-4, respectively. The thermistors THS4R, THS5, and THS6 detect the right end temperatures of the heating resistors 302-4, 302-5, and 302-6, respectively.

The control circuit 400 controls the energization amount (magnitude of power) to each of the heating resistors 302-1 to 302-7 to control the amount of heat generated by each of the heating resistors 302-1 to 302-7 and control the heating amount of the film 202 in each heating region. The heating amount is a power supplied per unit length in the longitudinal direction of the heater to the heating resistors 302-1 to 302-7, and is expressed in units of W/mm in Embodiment 1. For example, where the same power is applied to heating elements with different lengths, the generated heat amount will differ according to the length, and when power is supplied to each heating element with the same power per unit length, the generated heat amount of each heating element is the same.

Figure 4:
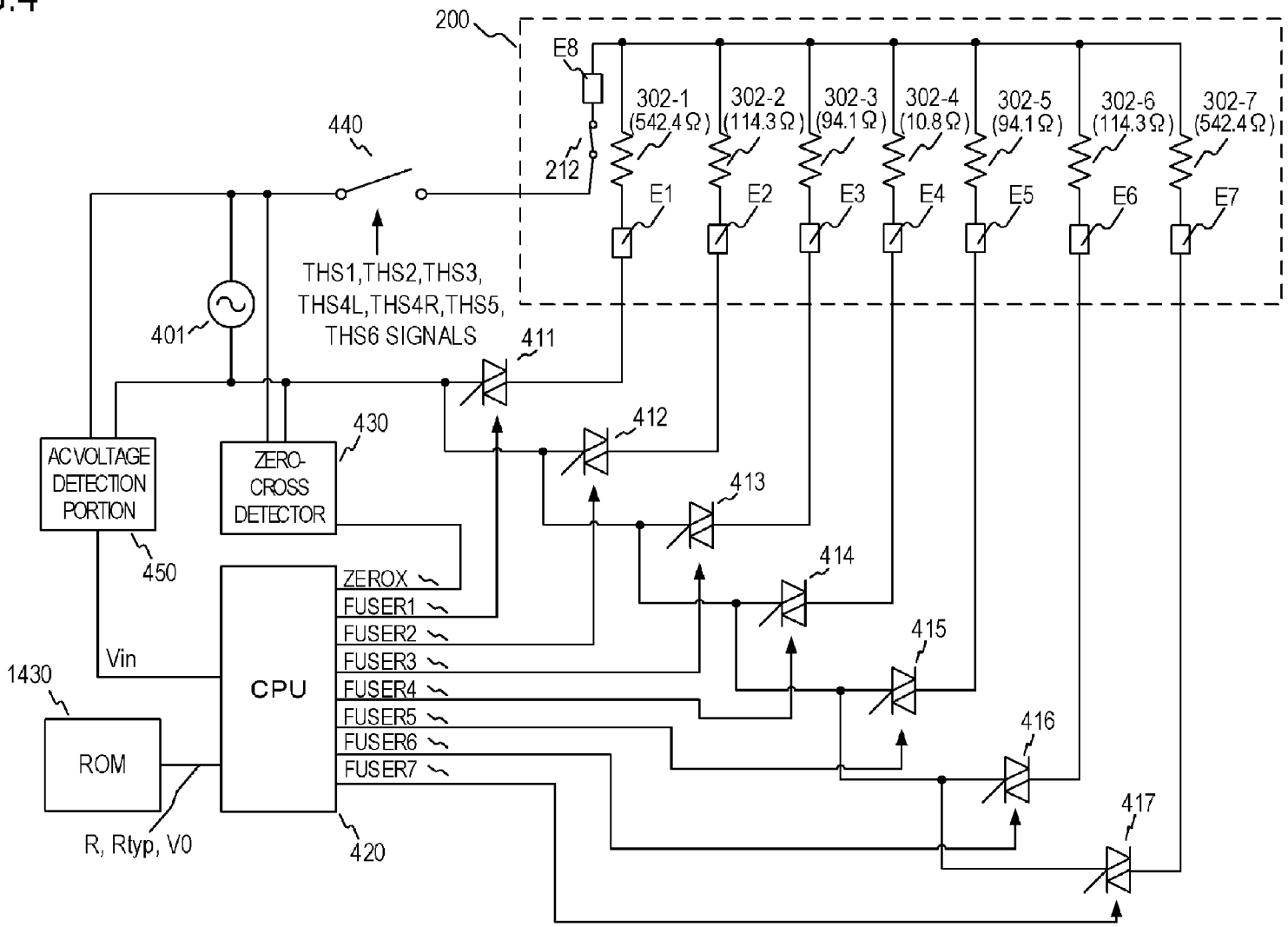
FIG. 4 is a control circuit diagram of Embodiment 1.

FIG. 4 is a control circuit diagram of the control circuit 400 in Embodiment 1. The power control of the heater 300 is performed by turning on/off triacs 411 to 417. Power is supplied to the heater 300 via the electrodes E1 to E7. In this example, the explanation is given assuming that the resistance value of the heating resistors 302-1 and 302-7 is 542.4Ω, the resistance value of the heating resistors 302-2 and 302-6 is 114.3Ω, the resistance value of the heating resistors 302-3 and 302-5 is 94.1Ω, and the resistance value of the heating resistor 302-4 is 10.8Ω.

A zero-cross detector 430 is a circuit that detects a zero-cross of the AC power source 401, and outputs a ZEROX signal to a CPU 420. The ZEROX signal is used for heater control, and a method described in Japanese Patent Application Publication No. 2011-18027 can be used as an example of a zero-cross circuit. A relay 440 is used as a means for shutting off power supply to the heater 300 when the thermistors THS2 to THS6 detect an excessive temperature rise in the heater 300 due to a failure or the like. Also, a thermo-switch 212 operates when the temperature of the heater 200 rises abnormally and cuts off the power supply to the heater 200.

The triacs 411 to 417 operate according to FUSER 1 to FUSER 7 signals from the CPU 420, respectively. When the triacs 411 to 417 are energized, power is supplied to the heating resistors 302-1 to 302-7, respectively.

In the internal processing of the CPU 420, a value obtained by multiplying a preset heating amount Qzi [W/mm] (i=1 to 7) by a width Li [mm] (i=1 to 7) of each heating resistor in the longitudinal direction of the heater is calculated as a power supply Di [W] (i=1 to 7) supplied to each heating resistor.

When there is a spread in the voltage of the AC power supply or the resistance of the heating resistors 302-1 to 302-7, an actual power supply Dri [W] (i=1 to 7) to the heating resistors 302-1 to 302-7 may differ from the calculated power supply Di. Where the designed total resistance value of the heating resistors 302-1 to 302-7 is denoted by Rtyp [Ω], the actual total resistance value is denoted by R [Ω], the reference voltage is denoted by V0 [V], and the actual voltage is denoted by Vin [V], the actual power supply Dri is $(Vin^2/R)/(V0^2/Rtyp)\times Di$.

A method for correcting this spread will be described hereinbelow. A ROM 1430 is a storage means for recording the designed total resistance value Rtyp of the heating resistors 302-1 to 302-7, the reference voltage V0, and the actual total resistance values R of the heating resistors 302-1 to 302-7 measured in advance, and transmitting the recorded values to the CPU 420. In the AC voltage detection portion 450, the voltage Vin of the AC power source 401 is detected and transmitted to the CPU 420 as a Vin signal. The CPU 420 calculates a corrected power supply Dci [V] (i=1 to 7) to the heating resistors 302-1 to 302-7 from the designed total resistance value Rtyp, the actual total resistance value R, the detection voltage Vin, and the reference voltage V0 based on the following formula.

$$Dci=(V0^2/\mathrm{Rtyp})/(V\mathrm{in}^2/R)\times Di$$

With this method, $\mathrm{Dri}=(\mathrm{Vin}^2/\mathrm{R})/(\mathrm{V0}^2/\mathrm{Rtyp})\times\mathrm{Dci}=\mathrm{Di}$. Even when there is a spread in the voltage of the AC power source 401 or the resistance value of the heater 300, it is possible to provide the intended heating amount to the film 202.

Further, the CPU 420 performs conversion to control levels of a phase angle (phase control) and a wave number (wave number control) corresponding to each of the corrected power supply Dc1 to Dc7 to the heating resistors 302-1 to 302-7, and controls the triacs 411 to 417 by this control condition.

Figure 5:
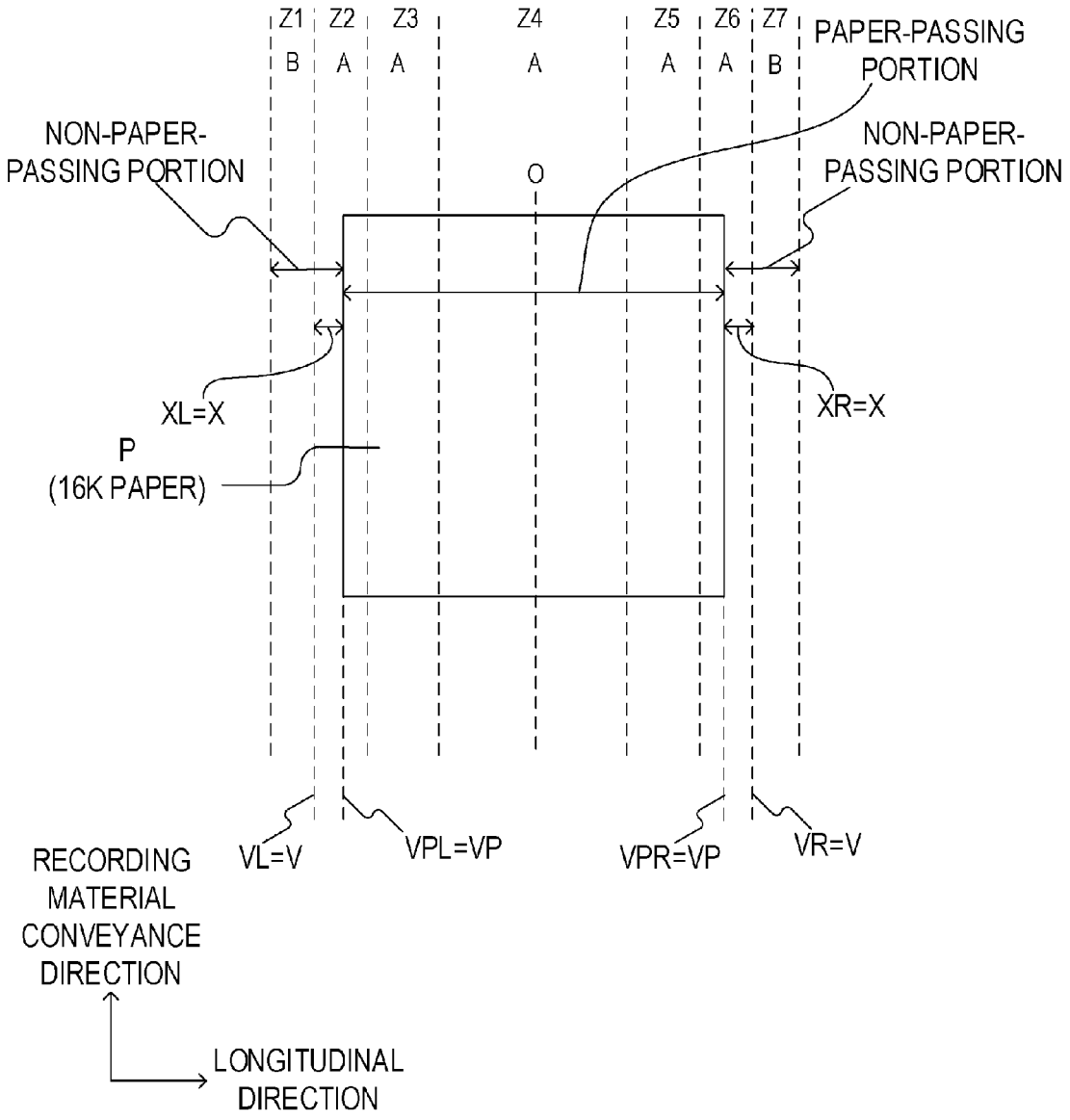
FIG. 5 is an explanatory diagram of the positional relationship between the recording material passage position in the longitudinal direction and each heating region.

FIG. 5 is a diagram illustrating the positional relationship between each heating region and the passing position of the recording material in the longitudinal direction of the fixing nip (the longitudinal direction of the heater) orthogonal to the recording material conveyance direction in Embodiment 1.

In the longitudinal direction of the nip, a region through which the recording material P passes is called a paper-passing portion, and a region through which the recording material P does not pass is called a non-paper-passing portion.

A heating region through which the recording material passes at least partially is referred to as a paper-passing heating region, and is denoted by A in FIG. 5. Meanwhile, a heating region where the recording material itself does not pass through is referred to as a non-paper-passing heating region, and is denoted by B in FIG. 5. Whether each heating region corresponds to a paper-passing heating region or a non-paper-passing heating region is determined depending on the paper width W of the recording material P. Specifically, it is determined based on Table 2. A in the table indicates a paper-passing heating region, and B indicates a non-paper-passing heating region.

TABLE 2

| Paper width W | Heating region Z1 | Heating region Z2 | Heating region Z3 | Heating region Z4 | Heating region Z5 | Heating region Z6 | Heating region Z7 |
|---|---|---|---|---|---|---|---|
| W ≤ 148 mm | B | B | B | A | B | B | B |
| 148 mm < W ≤ 182 mm | B | B | A | A | A | B | B |
| 182 mm < W ≤ 210 mm | B | A | A | A | A | A | B |
| 210 mm < W ≤ 215.9 mm | A | A | A | A | A | A | A |

Further, a distance between a boundary position V between the paper-passing heating region and the non-paper-passing heating region in the longitudinal direction, and an end portion position VP of the recording material P on the boundary position side is defined as a distance X. The boundary position V, the end portion position VP, and the distance X have two values each on the left and right sides in the longitudinal direction with respect to the paper conveyance reference position O. Specifically, there are a boundary position VL, a recording material end portion position VPL, and a distance XL on the left side in the longitudinal direction, and a boundary position VR, a recording material end portion position VPR, and a distance XR on the right side in the longitudinal direction. Since the recording material P in Embodiment 1 is conveyed while being arranged at symmetrical positions with respect to the paper conveyance reference position O, the boundary positions VL and VR, the distances XL and XR, and the recording material end portion positions VPL and VPR have the same values in each pair. Therefore, in Embodiment 1, the control is performed by regarding the boundary positions VL and VR as one value V, the recording material end portion positions VPL and VPR as one value VP, and the distances XL and XR as one value X.

In the case where a recording material P in which the boundary position V does not coincide with the recording material end portion position VP (hereinafter, referred to as a divided-position non-corresponding size paper), as in the recording material P shown in FIG. 5, is continuously passed, it is possible that a non-paper-passing portion temperature rise will occur in the non-paper-passing portion between the boundary position V and the recording material end portion position VP. Where the non-paper-passing portion temperature rise occurs, the temperature of the thermistor disposed in the corresponding non-paper-passing portion, among the thermistors THS2 to THS6, rises compared to the case where the non-paper-passing portion temperature rise does not occur. As shown in FIG. 5, when the end portion positions of the recording material in the longitudinal direction are located at Z2 and Z6, the temperatures of the thermistors THS2 and THS6 increase.

The control circuit 400 determines whether or not the temperature of the non-paper-passing portion is increasing based on the temperatures detected by the thermistors THS2 to THS6. Where it is detected that one or more detection temperatures of the thermistors THS2 to THS6 exceed a predetermined upper limit value THMax, the control circuit 400 extends the paper interval at the time of printing by 100 mm, and reduces the throughput. In the case of a throughput reduction from the normal state, the paper interval increases from 50 mm to 150 mm. At this time, for example, in the case of 16K paper, the throughput decreases from 61 ppm to 47 ppm. THMax is the detection temperature of the thermistors THS2 to THS6 at the respective position when the temperature of the film 202 in the non-paper-passing portion between the boundary position V and the recording material end portion position VP reaches the heat resistance temperature 220° C. of the film. In Embodiment 1, THMax=270° C.

Description of Heating Control of Film 202 in Embodiment 1

Described hereinbelow is a method for heating control of the film 202 while the k-th (1≤k≤N−1) recording material to be heated passes through the fixing nip N when the toner images formed on N (N≥2) recording materials are continuously heated using the fixing device of Embodiment 1. The heating amount of the film 202 (the power supply amount to the heater (heating resistor)) differs between the case of the paper-passing heating region and the case of the non-paper-passing heating region.

First, in the paper-passing heating region, a heating amount QA necessary to maintain the temperature of the film 202 at a temperature TA (fixing temperature TA) at which the toner image is sufficiently fixed on the recording material when the unfixed toner image on the recording material P is fixed is applied to the film 202. When the toner image printed on Letter paper was heated and fixed using the image forming apparatus of Embodiment 1, the temperature of the film 202 at which the toner image was sufficiently fixed on the recording material was 170° C. Further, the heating amount required to keep the temperature of the film 202 at the temperature TA was 2.30 W/mm. Therefore, in Embodiment 1, the heating amount QA is set to 2.30 W/mm.

Meanwhile, the heating control of the film 202 in the non-paper-passing heating region is switched between the below-described first control mode and second control mode according to the distance X.

In the first control mode, control is performed to apply a heating amount Q1 lower than the heating amount QA to the film 202 in the non-paper-passing heating region. That is, power is supplied at the first power as the heating amount QA to the heating resistor for heating the paper-passing heating region, and power is supplied at the second power, which is smaller than the first power, as the heating amount Q1 to the heating resistor for heating the non-paper-passing heating region. The specific value of the heating amount Q1 will be described hereinbelow.

In the second control mode, control is performed to apply a heating amount Q2, which is lower than the heating amount Q1, to the film 202 in the non-paper-passing heating region. That is, power is supplied at the first power as the heating amount QA to the heating resistor for heating the paper-passing heating region, and power is supplied at the third power, which is smaller than the second power, as the heating amount Q2 to the heating resistor for heating the non-paper-passing heating region. The specific value of the heating amount Q2 will be described hereinbelow.

Figure 6:
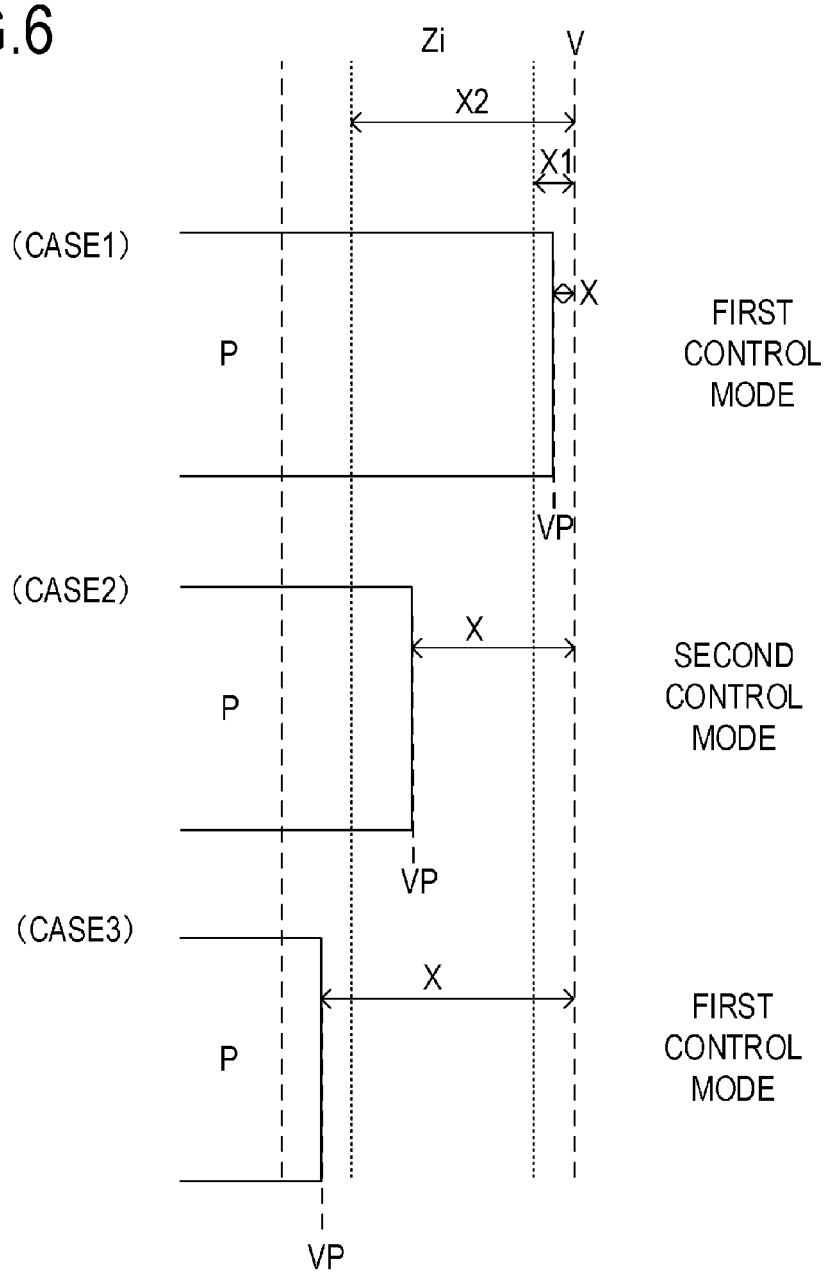
FIG. 6 is a diagram showing the correspondence relationship between the distance X and the first control mode and the second control mode.

FIG. 6 is a diagram showing the correspondence relationship between the first control mode, the second control mode and the distance X. FIG. 6 shows which control mode is to be selected in the three cases, Case 1, Case 2, and Case 3 described below according to the relationship between the distance X between the end portion position of the recording material P and the boundary position V in a certain heating region Zi and thresholds X1 and X2 described hereinbelow.

Case 1 will be described as a case where the distance X at the k-th recording material is smaller than a predetermined threshold X1. In this case, the heating amount of the film 202 is controlled in the first control mode. In this case, the boundary position V between the paper-passing heating region and the non-paper-passing heating region and the recording material end portion position VP are close to each other so that the non-paper-passing portion temperature rise does not occur. In this case, priority is given to rising the temperature for the next recording material over reducing the non-paper-passing portion temperature rise in continuous paper passing, and control is performed by setting the heating amount of the film 202 in the non-paper-passing heating region at the k-th recording material to the heating amount Q1 such that the temperature is maintained at or above T1 at which the rise is in time for the next recording medium. In Embodiment 1, the threshold X1 is 1 mm.

Case 2 will be described as a case where the distance X at the k-th recording material is equal to or larger than the threshold X1 and smaller than a predetermined threshold X2 (X2>X1). In this case, the heating amount of the film 202 is controlled in the second control mode. In this case, since the boundary position V and the recording material end portion position VP are farther apart than in Case 1, the non-paper-passing portion temperature rise occurs. Further, by lowering the heating amount in the non-paper-passing heating region, the non-paper-passing portion temperature rise is reduced. This is because the position in the longitudinal direction at which the non-paper-passing portion temperature rise occurs is not that far from the boundary position V, so that the heat generated by the non-paper-passing portion temperature rise easily moves to the non-paper-passing heating region. Accordingly, priority is given to reducing the non-paper-passing portion temperature rise in continuous paper passing, and control is performed by setting the heating amount in the non-paper-passing heating region at the k-th recording material to a heating amount Q2 which is lower than in the first control mode. In Embodiment 1, the threshold X2 is set to 10 mm (the reason will be described later).

Case 3 will be described as a case where the distance X at the k-th recording material is equal to or larger than the threshold X2. In this case, the temperature of the film 202 is controlled in the first control mode. In this case, the boundary position V and the recording material end portion position VP are so far apart that the temperature rise occurs in the non-paper-passing portion, and even if the heating amount of the non-paper-passing heating region is reduced, the non-paper-passing portion temperature rise does not decrease. This is because the position in the longitudinal direction at which the temperature rise occurs in the non-paper-passing portion is relatively far from the boundary position V, so that the heat generated by the non-paper-passing portion temperature rise does not easily move to the non-paper-passing heating region. In this case, since the non-paper-passing portion temperature rise is not expected to be reduced, priority is given to rising the temperature for the next recording material, and control is performed by setting the heating amount of the film 202 in the non-paper-passing heating region at the k-th recording material to the heating amount Q1 such that the temperature is maintained at or above T1 at which the rise is in time for the next recording medium.

Next, specific values of the temperature T1 and the heating amount Q1 in Embodiment 1 will be described.

The rise time Δt is defined as a difference in time between a time point at which the rear end position in the conveyance direction of the k-th recording material ends passing through the fixing nip N, and a time point at which the leading end position in the conveyance direction of the next recording material on which the image is to be heated at a minimum paper interval starts to pass through the fixing nip N. Specifically, the value of 0.15 s obtained by dividing the minimum paper interval of 50 mm in the image forming apparatus of Embodiment 1 by the process speed of 330 mm/s is taken as Δt.

The temperature T1 is a temperature such that the temperature of the film 202 in the non-paper-passing heating region of the k-th recording material can be made to reach the fixing temperature TA within the rise time Δt.

Further, when two sheets of Letter paper were continuously passed using the image forming apparatus of Embodiment 1, it was found that the temperature of the film 202 increased by 5° C. within a paper interval of 50 mm (within 0.15 s). Therefore, in Embodiment 1, the temperature T1 is set to 165° C., which is obtained by subtracting 5° C. from TA=170° C. Further, the heating amount required to maintain the temperature of the film 202 at or above the temperature T1 was 2.22 W/mm Therefore, in Embodiment 1, the heating amount Q1 is set to 2.22 W/mm.

Specific values of the heating amount Q2 in Embodiment 1 will be described with reference to FIGS. 7 and 8.

Figure 7:
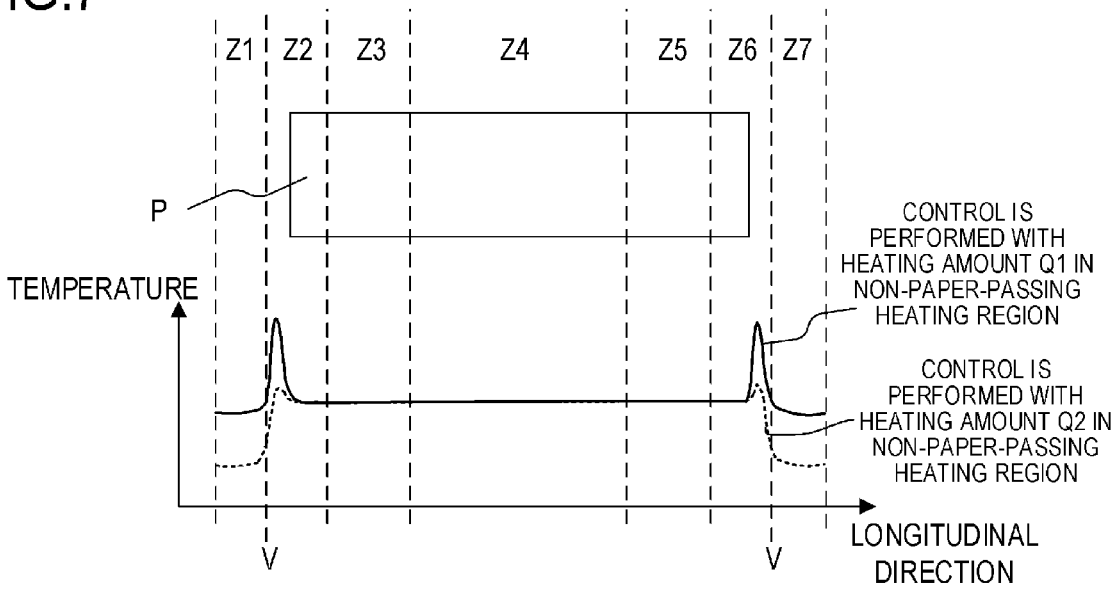
FIG. 7 shows a temperature distribution in a film 202 when 16K paper is continuously passed in Embodiment 1.

FIG. 7 shows the position of the recording material P in the longitudinal direction and the temperature distribution in a film 202 in the longitudinal direction in the case where ten sheets of 16K paper as divided-position non-corresponding size paper are continuously passed using the image forming apparatus of Embodiment 1.

The solid line in the graph of FIG. 7 represents the temperature distribution in the longitudinal direction of the fixing film when control is performed by the heating amount Q1 in the non-paper-passing heating region, and this line shows that a non-paper-passing portion temperature rise occurs in the non-paper-passing portions in the heating regions Z2 and Z6.

The dotted line in the graph of FIG. 7 represents the temperature distribution in the longitudinal direction of the fixing film when control is performed by the heating amount Q2 in the non-paper-passing heating region. The temperature of the film 202 on the outside of the boundary position V in the longitudinal direction (the heating region present on the left side of the boundary position VL and on the right side of the boundary position VR) decreases as compared with the case where the control is performed by the heating amount Q1, and the non-paper-passing portion temperature rise can be reduced.

Figure 8:
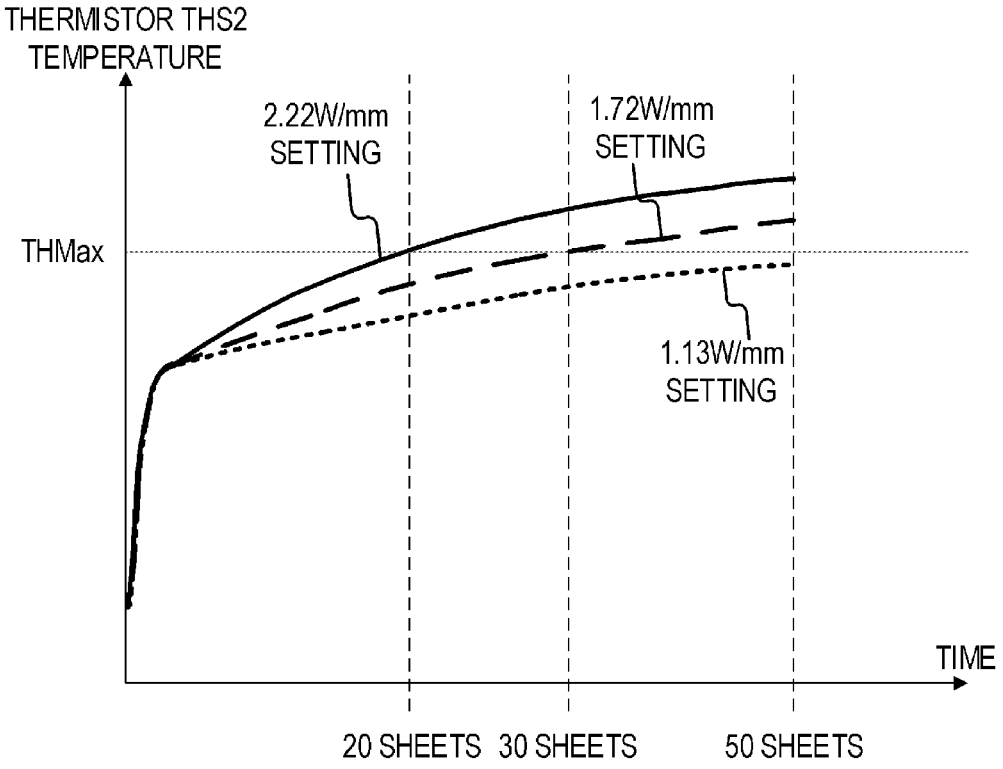
FIG. 8 shows a temperature change of a thermistor THS2 when 16K paper is continuously passed in Embodiment 1.

FIG. 8 shows the temperature change of the thermistor THS2 when 50 sheets of 16K paper were continuously passed without reducing the throughput by using the image forming apparatus of Embodiment 1. The solid line, the broken line, and the dotted line show the temperature change when the heating amount Q2 to the film 202 in the non-paper-passing heating region was 2.22 W/mm, 1.72 W/mm, and 1.13 W/mm, respectively. When the heating amount Q2 in the non-paper-passing heating region was 2.22 W/mm, the temperature of the thermistor THS2 reached THMax (270° C.) at the 20th sheet. When the heating amount Q2 in the non-paper-passing heating region was 1.72 W/mm, the temperature of the thermistor THS2 reached THMax (270° C.) at the 30th sheet. When the heating amount Q2 in the non-paper-passing heating region was 1.13 W/mm, the 50th sheet could be continuously passed without the temperature of the thermistor THS2 reaching THMax (270° C.). Therefore, in Embodiment 1, Q2=1.13 W/mm.

Why the heating control in Case 3 is performed by setting the heating amount Q1 will be described with reference to FIGS. 9 and 10. Further, a specific value of the threshold X2 and the basis thereof will be described with reference to FIG. 11.

Figure 9:
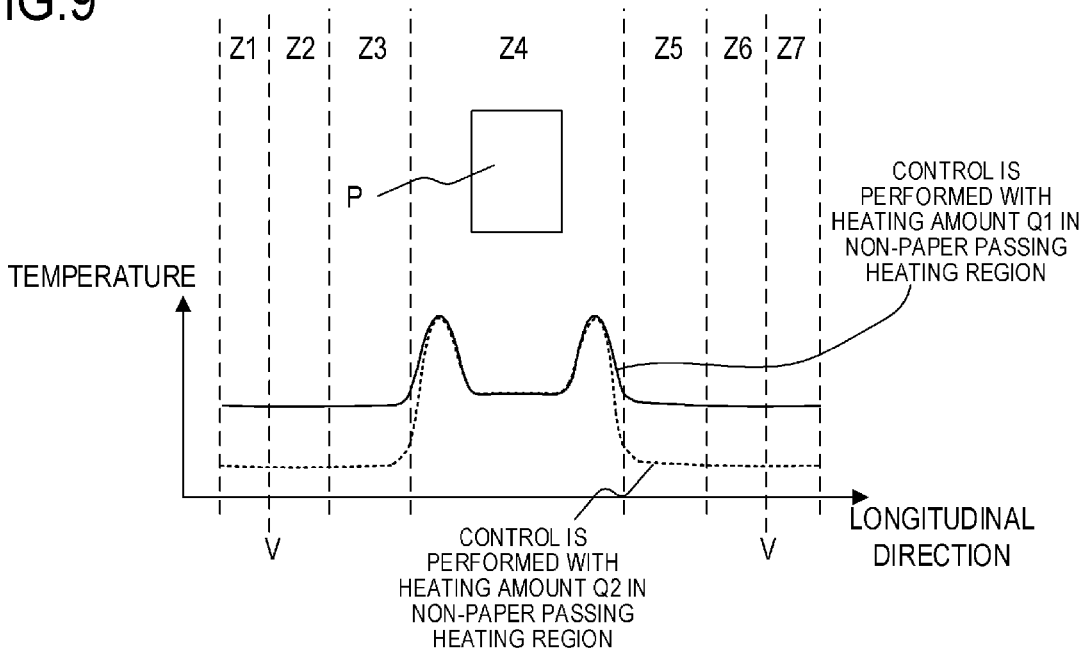
FIG. 9 shows a temperature distribution in the film 202 when a COM10 envelope is continuously passed in Embodiment 1.

FIG. 9 shows the position of the recording material P in the longitudinal direction and the temperature distribution of the film 202 in the longitudinal direction when two COM10 envelopes are continuously passed as divided-position non-corresponding size paper using the image forming apparatus of Embodiment 1.

The solid line in the graph of FIG. 9 represents the temperature distribution in the longitudinal direction of the fixing film when control is performed by the heating amount Q1 in the non-paper-passing heating region, and this line shows that a non-paper-passing portion temperature rise occurs in the non-paper-passing portion in the heating region Z4.

The dotted line in the graph of FIG. 9 represents the temperature distribution in the longitudinal direction of the fixing film when control is performed with the heating amount Q2 in the non-paper-passing heating region. In the COM10 size, the recording material end portion position VP is farther from the boundary position V than in the 16K paper. For this reason, even if the heating amount of the film 202 in the heating region on the outer side in the longitudinal direction of the boundary position V is reduced to the heating amount Q2, the degree of the non-paper-passing portion temperature rise is almost the same as in the case of the heating amount Q1.

Figure 10:
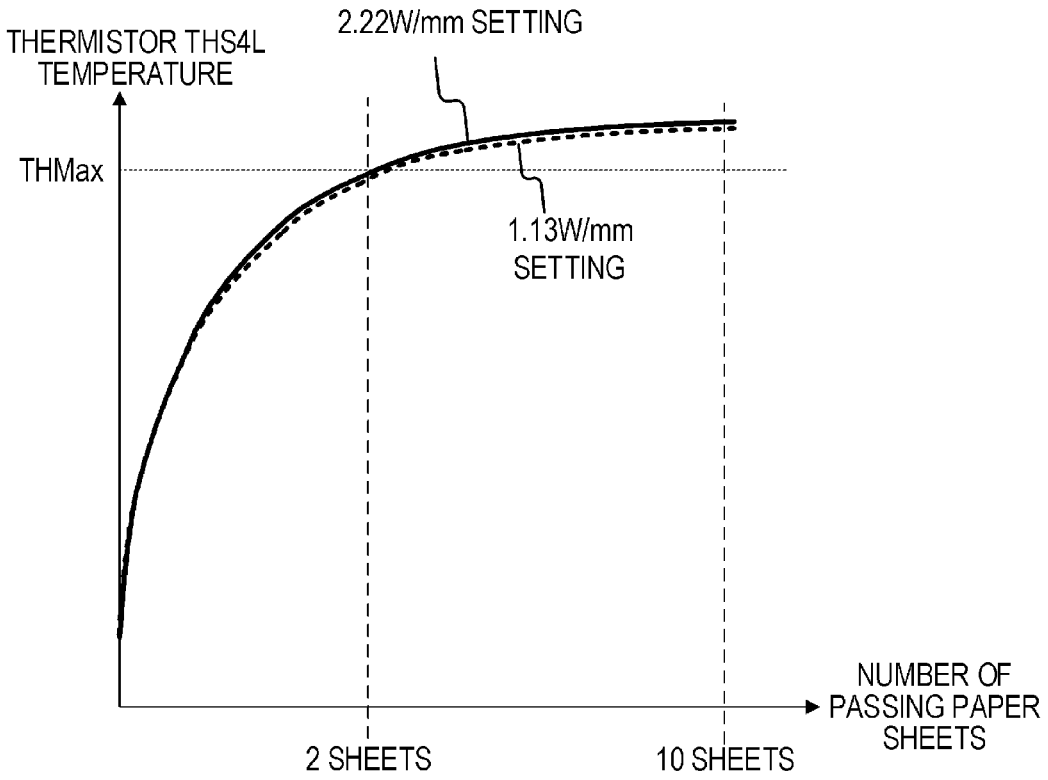
FIG. 10 shows a temperature change of a thermistor THS2 when a COM10 envelope is continuously passed in Embodiment 1.

FIG. 10 shows the temperature change of the thermistor THS4L when ten COM10 envelopes are continuously passed without reducing the throughput by using the image forming apparatus of Embodiment 1. The solid line and the broken line show the temperature change when the heating amount Q2 to the non-paper-passing heating region was 2.22 W/mm and 1.13 W/mm, respectively. When the heating amount in the non-paper-passing heating region was 2.22 W/mm, the temperature of the thermistor THS4L reached THMax (270° C.) at the second sheet. When the heating amount in the non-paper-passing heating region was 1.13 W/mm, the temperature of the thermistor THS4L reached THMax (270° C.) also at the second sheet. Therefore, in the COM10 envelope, even when the heating amount in the non-paper-passing heating region is reduced to the heating amount Q2, there is no effect, and it is better to give priority to rising the temperature for the next recording material and to perform control with the heating amount Q1.

Figure 11:
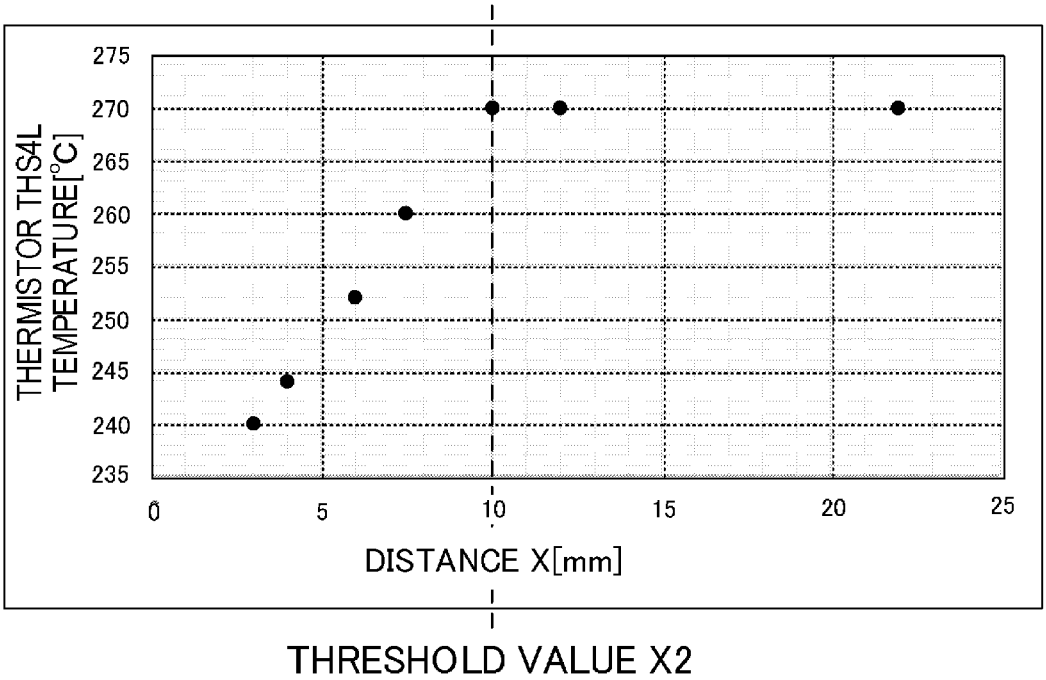
FIG. 11 is a graph showing the relationship between the distance X and the thermistor THS4L in Embodiment 1.

FIG. 11 shows graphically the relationship between the distance X and the thermistor THS4L when images are formed on ten continuously passing paper sheets of the recording material P without reducing the throughput in the second control mode by using the image forming apparatus of Embodiment 1. In the graph, the distance X is plotted on the abscissa, and the paper width of the recording material P having a paper width of 148 mm or less is varied from 104 mm to 142 mm, thereby varying the distance X from 3 mm to 22 mm. The detection temperature of the thermistor THS4L is plotted against the ordinate of the graph and indicates the degree of the non-paper-passing portion temperature rise. As the distance X increases, the effect of reducing the heating amount in the non-paper-passing heating region to the heating amount Q2 decreases, and the temperature of the thermistor THS4L rises. When the distance X exceeds 10 mm, the temperature of the thermistor THS4L becomes 270° C., and the effect of reducing the non-paper-passing portion temperature rise is lost. Therefore, in Embodiment 1, the threshold X2 is set to 10 mm.

Control Flowchart of Image Heating Device in Embodiment 1

Figure 12:
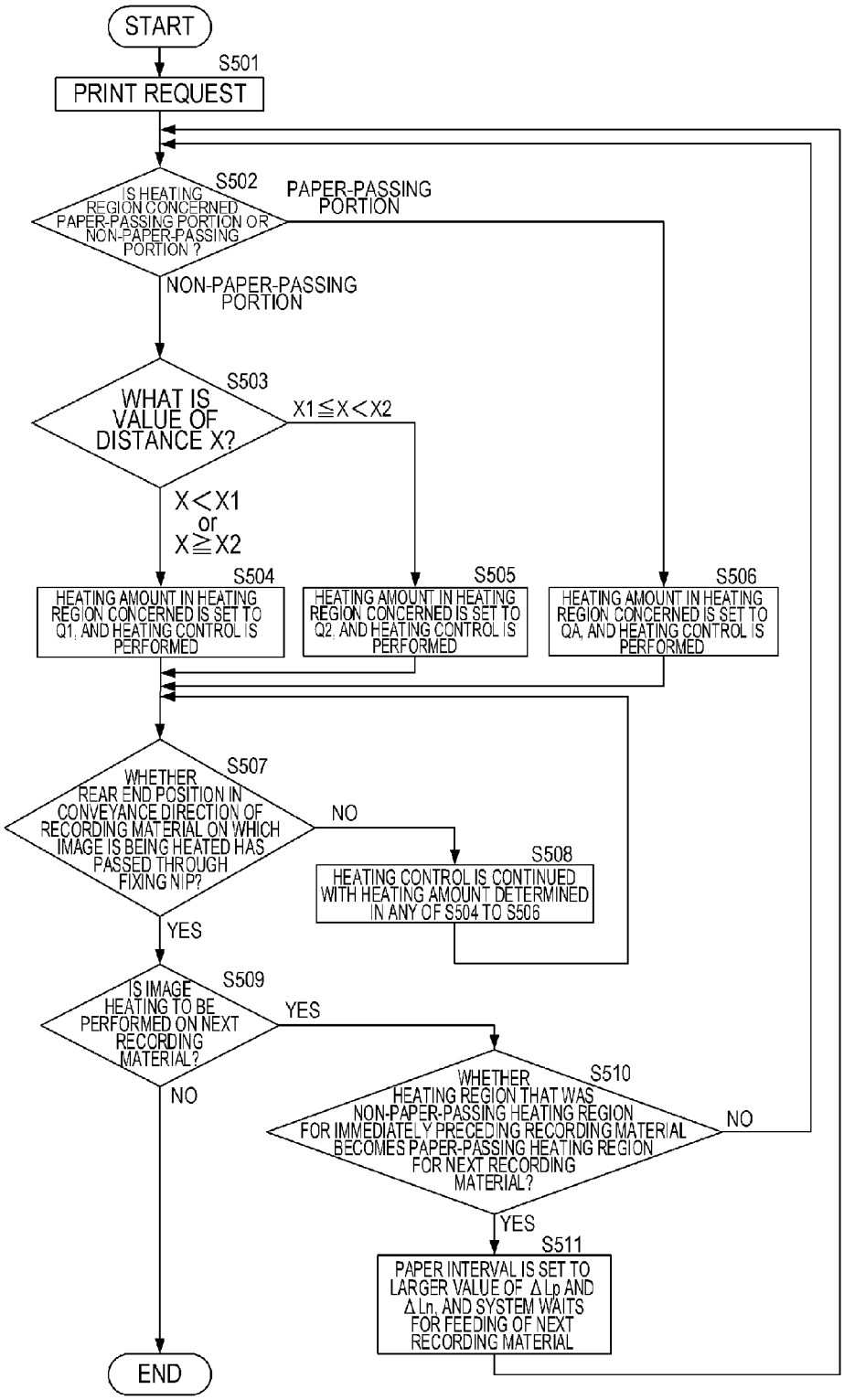
FIG. 12 is a control flowchart of the fixing device according of Embodiment 1.

FIG. 12 is a flowchart illustrating a heating control sequence of the fixing device 200 by the control circuit 400 when printing on the recording material P in the image forming apparatus according to Embodiment 1. However, this flowchart shows a temperature control sequence for a certain heating region (hereinafter, referred to as a heating region concerned). In each of the heating regions Z1 to Z7, determination is independently performed based on this flowchart to perform heating control of the film 202.

When a print request is generated in step S501, the process proceeds to step S502, and whether the heating region concerned is a paper-passing heating region or a non-paper-passing heating region is determined based on the paper width W of the recording material P passing through the fixing nip and Table 2. Where it is determined that the heating region concerned is the non-paper-passing heating region, the process proceeds to S503. Meanwhile, where it is determined that the heating region concerned is the paper-passing heating region, the process proceeds to S506.

In S503, it is determined what is the value of the distance X. Where the distance X is smaller than the threshold X1, or where the distance X is equal to or larger than the threshold X2, the process proceeds to S504. Where the distance X is equal to or larger than the threshold X1 and smaller than the threshold X2, the process proceeds to S505.

In S504, the heating amount of the film 202 in the heating region concerned is set to Q1, and heating control is performed.

In S505, the heating amount of the film 202 in the heating region concerned is set to Q2, and heating control is performed.

In S506, the heating amount of the film 202 in the heating region concerned is set to QA, and heating control is performed.

In S507, it is determined whether or not the rear end position in the conveyance direction of the recording material P on which an image is being heated has passed through the fixing nip. Where the passage has been completed, the process proceeds to S508, and where the passage has not been completed, the process proceeds to S509.

In S508, the heating control is continued with the heating amount determined in any of S504, S505, and S506, and the process proceeds to S507.

In S509, it is determined whether or not the image heating on the next recording material is to be performed. Where the image heating on the next recording material is to be performed, the process proceeds to S510. Where the image heating on the next recording material is not to be performed, the flow ends.

In S510, it is determined whether or not the heating region that was the non-paper-passing heating region for the recording material that has passed through the fixing nip becomes the paper-passing heating region for the next recording material. Where it becomes the non-paper-passing heating region for the next recording material, the process proceeds to S502. Where it becomes the paper-passing heating region for the next recording material, the process proceeds to S511.

In S511, the paper interval from the recording material that has passed through the fixing nip to the next recording material is set to the larger value of ΔLp and ΔLn, and the system waits for feeding of the next recording material. ΔLp is a paper interval required for raising the temperature of the film 202 in the heating region, which was the non-paper-passing heating region for the recording material that has passed through the fixing nip, to a temperature TA before the time point at which the leading end position in the conveyance direction of the next recording material starts to pass through the fixing nip N. Meanwhile, ΔLn is a paper interval required for lowering the temperature of the film 202 which was the non-paper-passing portion in the recording material that has passed through the fixing nip to a temperature at which the below-described hot offset does not occur before the time point at which the leading end position in the conveyance direction of the next recording material starts to pass through the fixing nip N. Where a time corresponding to the larger one of ΔLp and ΔLn (a value obtained by dividing the paper interval by a process speed of 330 mm/s) has elapsed since the recording material previously subjected to image heating has passed through the fixing nip, the process proceeds to S502, and a transition is made to the image heating operation of the next recording material.

Effect Verification in Embodiment 1

Effects obtained when the temperature of the film 202 is controlled in Embodiment 1 will be described hereinbelow. The total printing time was compared between a comparative example not using the present invention and Embodiment 1. The total printing time is the time required from the start of image formation of the first print to the end of the last recording material passing through the fixing nip. Specifically, in the case where N recording materials are continuously passed, the total printing time is calculated by adding up the time required from the start of power supply to the fixing device 200 until the first recording material reaches the fixing nip, the time required for the N recording materials to pass through the fixing nip, and the time required for the paper intervals.

The comparative example has a configuration in which the heating control of the film 202 in the non-paper-passing heating region is performed only in the second control mode regardless of the distance X.

The total printing time in a case where a total of 20 recording materials of COM10 envelope and Letter paper were alternately passed one by one (small-size/large-size mixed job) was compared between Embodiment 1 and comparative example.

Figure 13A:
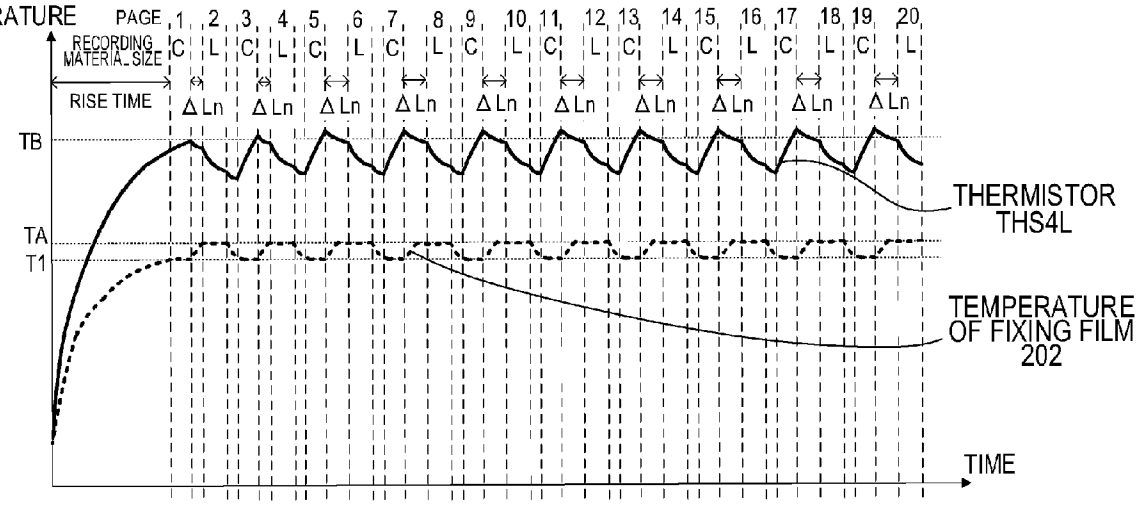
FIGS. 13A and 13B show temperature changes of the thermistor THS4L and the film 202 in the non-paper-passing heating region when a small-size/large-size mixed job is performed in Embodiment 1 and a comparative example.
Figure 13B:
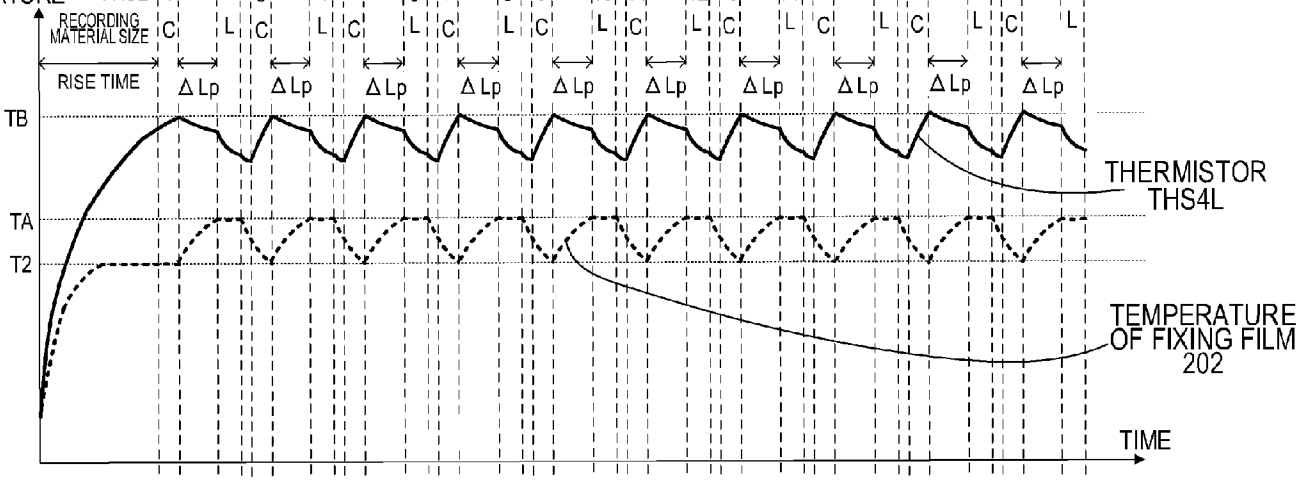

FIGS. 13A and 13B show the temperature change of the thermistor THS4L for non-paper-passing portion temperature rise detection and the film 202 in the non-paper-passing heating region when the small-size/large-size mixed job is performed in Embodiment 1 and the comparative example.

FIG. 13A shows the temperature change in Embodiment 1. The solid line indicates the temperature change of the thermistor THS4L, and the broken line indicates the temperature change of the film 202 in the non-paper-passing heating region. The numbers in the upper part of the drawing indicate the number of prints in the menu (hereinafter, referred to as a page). Further, letters therebelow indicate the size of the recording material. Here, L indicates Letter paper, and C indicates COM10 envelope.

In Embodiment 1, the heating control of the film 202 in the non-paper-passing heating region when forming an image on the COM10 envelope is performed in the first control mode.

When forming an image on the COM10 envelope, the non-paper-passing portion temperature rise occurs, and the temperature of the thermistor THS4L disposed in the non-paper-passing portion of the paper-passing heating region rises. Where the temperature of the thermistor THS4L is equal to or higher than the predetermined temperature TB at the time of forming an image on the Letter paper after the COM10 envelope, a hot offset may occur in which the toner image is over-melted. Therefore, the paper interval is set to ΔLn so that the temperature of the thermistor THS4L assumes a value lower than the temperature TB at the time of forming the image on the next Letter paper. In the image forming apparatus of Embodiment 1, TB=250° C. The time required for the paper interval ΔLn was 0.3 seconds, which is the same as the normal paper interval, immediately before the fourth Letter paper, but was 1 second immediately before the sixth Letter sheet.

Therefore, in Embodiment 1, the total printing time was 33 sec.

FIG. 13B shows the temperature change in the comparative example. The solid line shows the temperature change of the thermistor THS4L, and the broken line shows the temperature change of the film 202 in the non-paper-passing heating region.

In the comparative example, the heating control of the film 202 in the non-paper-passing heating region is performed only in the second control mode regardless of the distance X.

When forming an image on the COM10 envelope, the non-paper-passing portion temperature rise occurs, and the temperature of the thermistor THS4L disposed in the non-paper-passing portion of the paper-passing heating region rises. The paper interval is set to ΔLp so that a fixing defect does not occur in the region that was the non-paper-passing heating region in the COM10 envelope at the time of forming an image on the Letter paper next to the COM10 envelope. The time required for the paper interval ΔLp is 2 sec.

Therefore, in the comparative example, the total printing time was 45 sec.

In the case where a total of 20 printing materials of the COM10 envelope and the Letter paper are alternately passed one by one, the total printing time in Embodiment 1 is 12 sec shorter than that in the comparative example.

As described above, in Embodiment 1, the heating control of the film 202 in the non-paper-passing heating region is switched between the first control mode and the second control mode according to the distance X between the boundary position V between the paper-passing heating region and the non-paper-passing heating region and the recording material end portion position VP. This makes it possible to reduce the total printing time of the recording material for a small-size/large-size mixed job.

Embodiment 2

Embodiment 2 of the present invention will be described hereinbelow. Embodiment 2 differs from Embodiment 1 in the method for controlling the heating amount of the film 202 in the fixing device of the image forming apparatus 100. Embodiment 2 is different from Embodiment 1 in that the heating amount of the film 202 is controlled based on the detection temperature of the thermistor in contact with the back surface of the heater 300. The description of the same configuration as in Embodiment 1 will be omitted.

Figure 14:
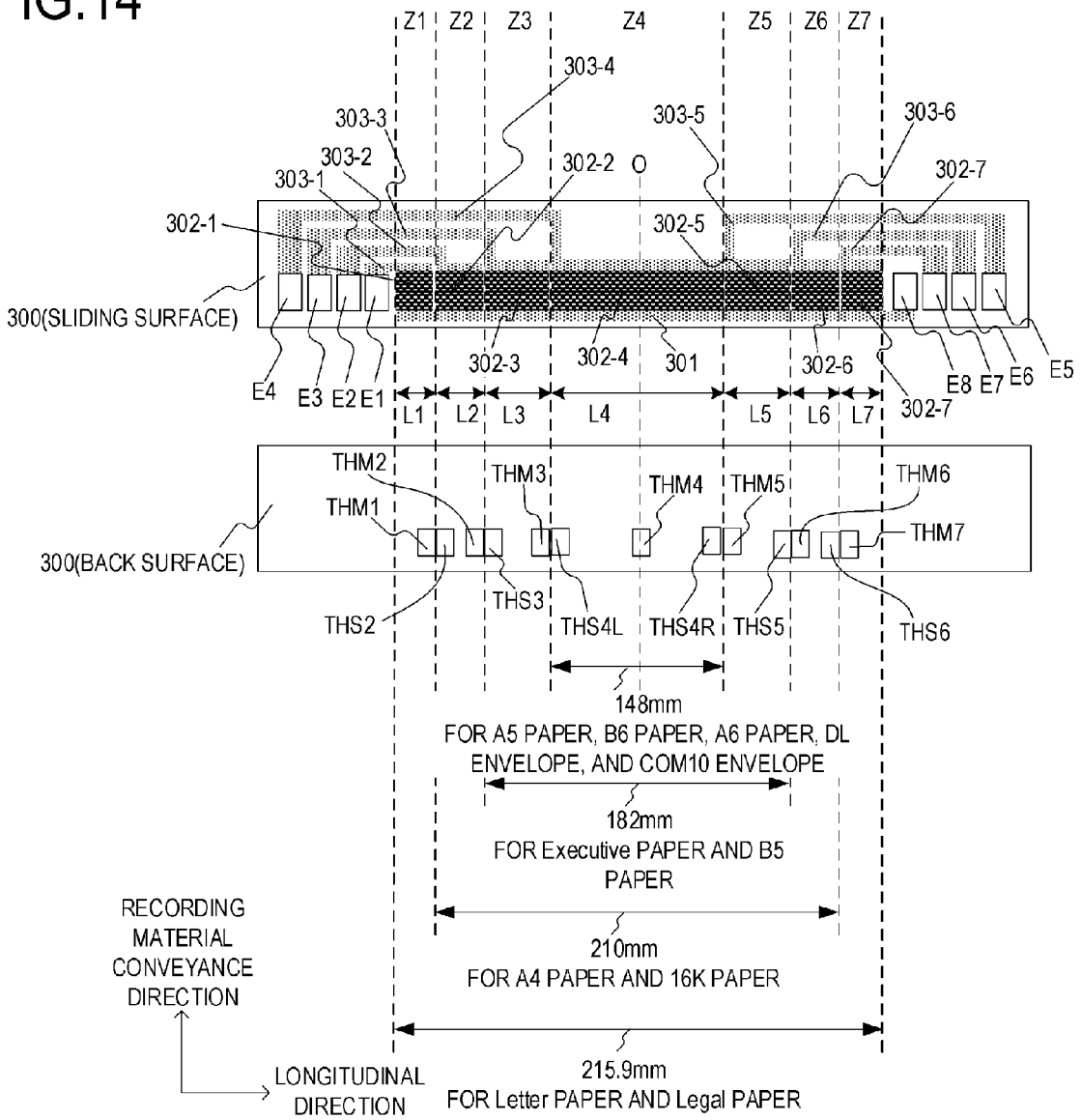
FIG. 14 is a heater configuration diagram of the Embodiment 2.

FIG. 14 is a configuration diagram of the heater 300 of Embodiment 2. The difference from Embodiment 1 is that in the heating regions Z1 to Z7, the thermistors THM1 to THM7 are arranged one by one on the back surface of the heater 300 at positions close to the paper conveyance reference position O.

The control circuit 400 controls the heating amount of the film 202 in each heating region by controlling the energization amount of each heating resistor 302-1 to 302-7 on the basis of the detection results of the thermistors THM1 to THM7.

Figure 15:
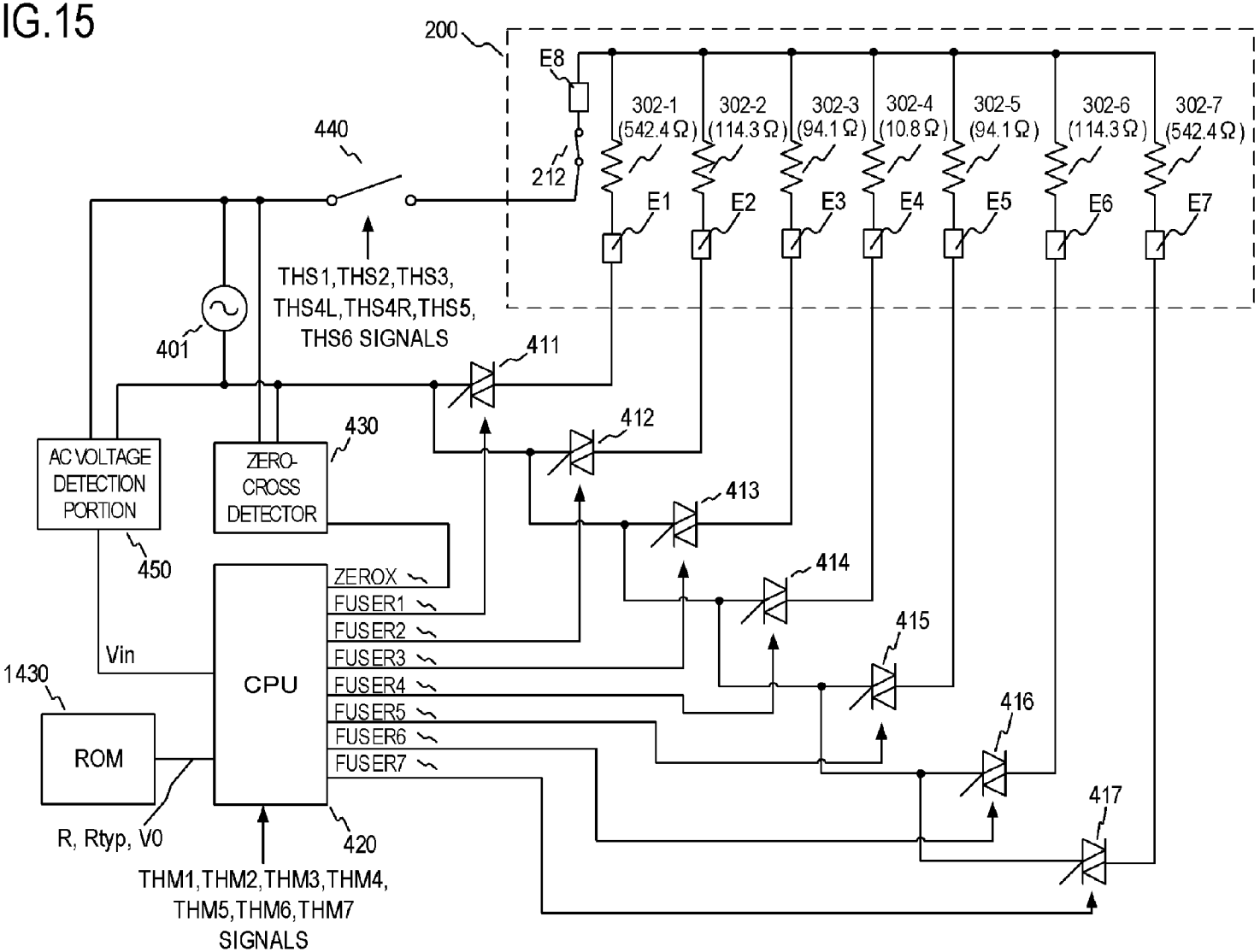
FIG. 15 is a control circuit diagram of Embodiment 2.

FIG. 15 is a control circuit diagram of the control circuit 400 in Embodiment 2. The reference numeral 401 denotes a commercial AC power source connected to the image forming apparatus 100. The triacs 411 to 417, the zero-cross detector 430, and the relay 440 are the same as those in Embodiment 1, and the description thereof will be omitted.

As for the temperature detected by the thermistor THM1, a voltage divided with a resistor (not shown) is detected by the CPU 420 as a THM1 signal. The detection for the thermistors THM2 to THM7 is performed by the CPU 420 in a similar manner. In the internal processing of the CPU 420, the heating amount Qzi [W/mm] (i=1 to 7) of each heating region is calculated by, for example, PI control on the basis of the detection temperatures of the thermistors THM1 to THM7 and the set temperature of the heater 300. The value obtained by multiplying the heating amount Qzi by the width Li [mm] (i=1 to 7) of each heating resistor in the longitudinal direction is calculated as power supply Di [W] (i=1 to 7) to the heating resistors 302-1 to 302-7, respectively. A method for correcting the spread in the voltage of the AC power supply and the resistance values of the heating resistors 302-1 to 302-7 is the same as that in Embodiment 1.

Further, the CPU 420 performs conversion to control levels of a phase angle (phase control) and a wave number (wave number control) corresponding to each of the corrected power supply Dc1 to Dc7 to the heating resistors 302-1 to 302-7, and controls the triacs 411 to 417 by this control condition.

Description of Heating Control of Heater 300 in Embodiment 2

Described hereinbelow is heating control of the heater 300 while the k-th ($1 \le k \le N-1$) recording material to be heated passes through the fixing nip N when the toner images formed on N ($N \ge 2$) recording materials are continuously heated using the fixing device of Embodiment 2. The control target temperature to be maintained in the heating control differs between the case of the paper-passing heating region and the case of the non-paper-passing heating region.

First, the target temperature in the heating control of the heater 300 in the paper-passing heating region is taken as a temperature THA (fixing temperature THA) at which the toner image is sufficiently fixed on the recording material P when the unfixed toner image is fixed on the recording material P. When the toner image printed on Letter paper was heated and fixed using the image forming apparatus of Embodiment 2, the temperature of the heater 300 at which the toner image was sufficiently fixed on the recording material was 220° C. Therefore, in Embodiment 2, the fixing temperature THA is set to 220° C.

Meanwhile, in the heating control of the heater 300 in the non-paper-passing heating region, the first control mode and the second control mode are switched according to the distance X, as in Embodiment 1.

The heating amount Q1 in Embodiment 2 is such that the temperature of the heater 300 in the non-paper-passing heating region of the k-th recording material is maintained at or above a temperature TH1 that makes it possible to reach the fixing temperature THA within the rise time Δt.

Further, when two sheets of Letter paper were continuously passed using the image forming apparatus of Embodiment 2, it was found that the temperature of the heater 300 increased by 10° C. within a paper interval of 50 mm (within 0.15 s). Therefore, in Embodiment 2, the temperature TH1 is set to 210° C., which is obtained by subtracting 10° C. from the temperature THA=220° C.

The heating amount Q2 in Embodiment 2 is a heating amount necessary for controlling the temperature of the heater 300 in the non-paper-passing heating region on the k-th sheet to a temperature TH2 which is lower than the temperature TH1.

Figure 16:
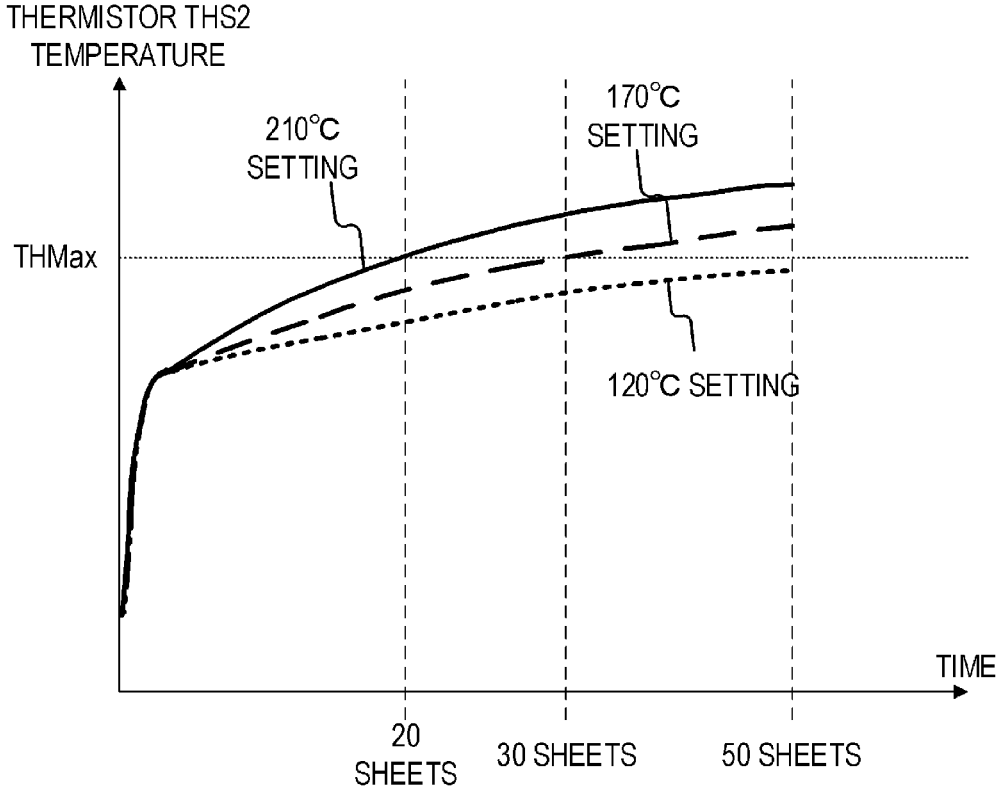
FIG. 16 shows the temperature change of the thermistor THS2 when 16K paper is continuously passed in Embodiment 2.

The temperature TH2 will be explained hereinbelow by using FIG. 16. This figure shows the temperature change of the thermistor THS2 when 50 sheets of 16K paper were continuously passed without reducing the throughput by using the image forming apparatus of Embodiment 2. The solid line, the broken line, and the dotted line show the temperature change when the temperature TH2 of the heater 300 in the non-paper-passing heating region was set to 210° C., 170° C., and 120° C., respectively. When the temperature TH2 of the heater 300 in the non-paper-passing heating region was set to 210° C., the temperature of the thermistor THS2 reached THMax (270° C.) at the 20th sheet. When the temperature TH2 of the heater 300 in the non-paper-passing heating region was set to 170° C., the temperature of the thermistor THS2 reached THMax (270° C.) at the 30th sheet. When the temperature TH2 of the heater 300 in the non-paper-passing heating region was set to 120° C., the 50th sheet could be continuously passed without the temperature of the thermistor THS2 reaching THMax (270° C.). Therefore, in Embodiment 2, the temperature TH2=120° C.

Control Flowchart of Image Heating Device in Embodiment 2

Figure 17:
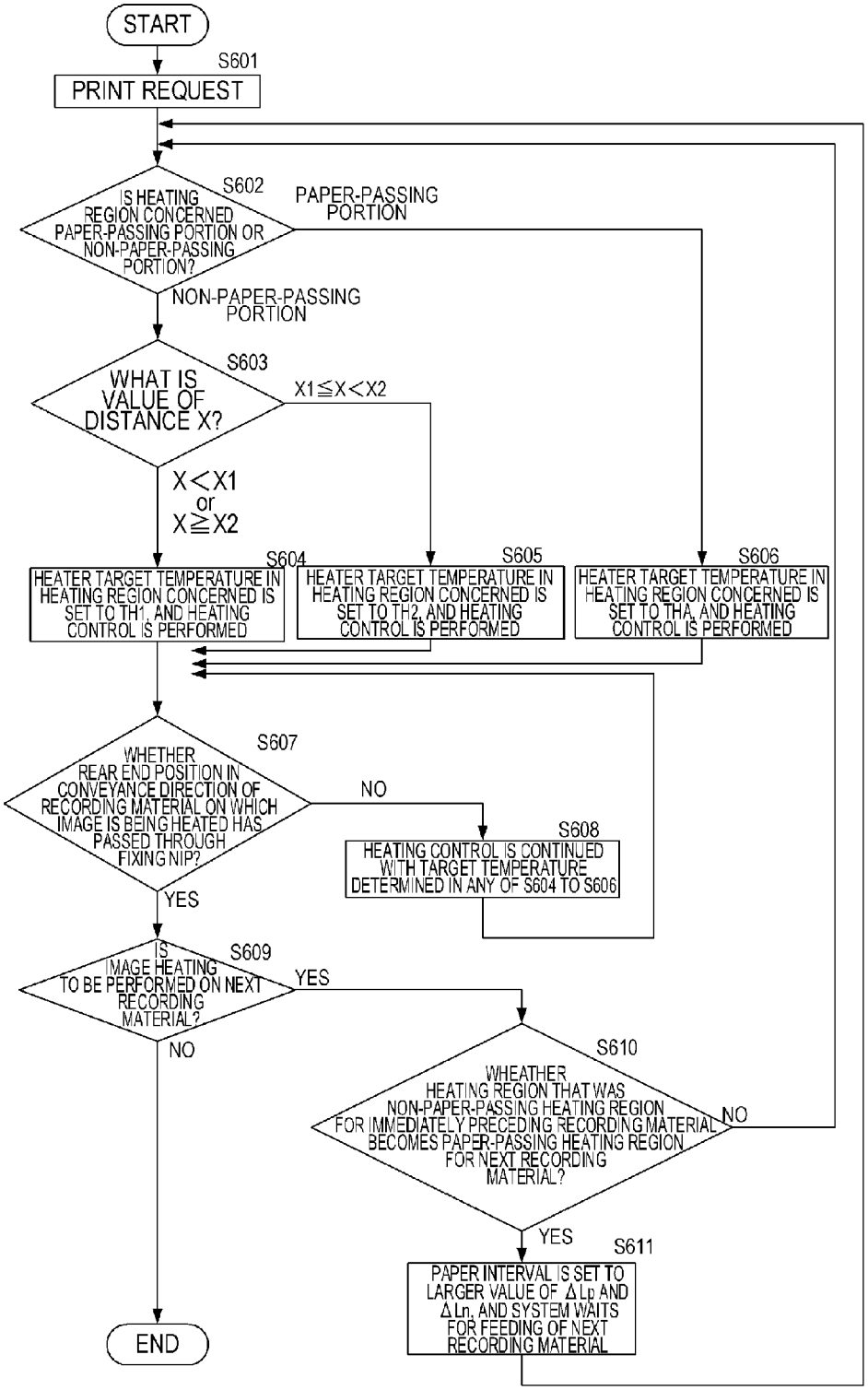
FIG. 17 is a control flowchart of the fixing device according to Embodiment 2.

FIG. 17 is a flowchart illustrating a temperature control sequence of the fixing device 200 by the control circuit 400 when printing on the recording material P in the image forming apparatus according to Embodiment 2. In each of the heating regions Z1 to Z7, determination is independently performed based on this flowchart to perform heating control of the heater 300.

When a print request is generated in step S601, the process proceeds to step S602, and whether the heating region concerned is a paper-passing heating region or a non-paper-passing heating region is determined based on the paper width W of the recording material P passing through the fixing nip and Table 2. Where it is determined that the heating region concerned is the non-paper-passing heating region, the process proceeds to S603. Meanwhile, where it is determined that the heating region concerned is the paper-passing heating region, the process proceeds to S606.

In S603, it is determined what is the value of the distance X. Where the distance X is smaller than the threshold X1, or where the distance X is equal to or larger than the threshold X2, the process proceeds to S604. Where the distance X is equal to or larger than the threshold X1 and smaller than the threshold X2, the process proceeds to S605.

In S604, the target temperature of the heater 300 in the heating region concerned is set to TH1, and heating control is performed.

In S605, the target temperature of the heater 300 in the heating region concerned is set to TH2, and heating control is performed.

In S606, the target temperature of the heater 300 in the heating region concerned is set to THA, and heating control is performed.

In S607, it is determined whether or not the rear end position in the conveyance direction of the recording material P on which an image is being heated has passed through the fixing nip. Where the passage has been completed, the process proceeds to S608, and where the passage has not been completed, the process proceeds to S609.

In S608, the heating control is continued with the target temperature determined in any of S604, S605, and S606, and the process proceeds to S607.

In S609, it is determined whether or not the image heating on the next recording material is to be performed. Where the image heating on the next recording material is to be performed, the process proceeds to S610. Where the image heating on the next recording material is not to be performed, the flow ends.

In S610, it is determined whether or not the heating region that was the non-paper-passing heating region for the recording material that has passed through the fixing nip becomes the paper-passing heating region for the next recording material. Where it becomes the non-paper-passing heating region for the next recording material, the process proceeds to S602. Where it becomes the paper-passing heating region for the next recording material, the process proceeds to S611.

In S611, the paper interval from the recording material that has passed through the fixing nip to the next recording material is set to the larger value of ΔLp and ΔLn, and the system waits for feeding of the next recording material. ΔLp is a paper interval required for raising the temperature of the heater 300 in the heating region, which was the non-paper-passing heating region for the recording material that has passed through the fixing nip, to a temperature THA before the time point at which the leading end position in the conveyance direction of the next recording material starts to pass through the fixing nip N. Meanwhile, ΔLn is a paper interval required for lowering the temperature of the heater 300 which was the non-paper-passing portion in the recording material that has passed through the fixing nip to a temperature at which the hot offset does not occur before the time point at which the leading end position in the conveyance direction of the next recording material starts to pass through the fixing nip N. Where a time corresponding to the larger one of ΔLp and ΔLn (a value obtained by dividing the paper interval by a process speed of 330 mm/s) has elapsed since the recording material previously subjected to image heating has passed through the fixing nip, the process proceeds to S602, and a transition is made to the image heating operation of the next recording material.

In Embodiment 2, the temperature control of the heater 300 in the non-paper-passing heating region is switched between the first control mode and the second control mode according to the distance X between the boundary position V between the paper-passing heating region and the non-paper-passing heating region and the recording material end portion position VP. This makes it possible to reduce the total printing time of the recording material for a small-size/large-size mixed job in the same manner as in Embodiment 1.

Embodiment 3

Embodiment 3 of the present invention will be described hereinbelow. Embodiment 3 differs from Embodiments 1 and 2 in the method for controlling the heating amount of the film 202 in the fixing device of the image forming apparatus 100. Embodiment 3 is different from Embodiment 1 in that the heating amount of the film 202 is controlled based on the detection temperature of the thermistors in contact with the film 202. The description of the same configuration as in Embodiment 1 will be omitted.

Figure 18:
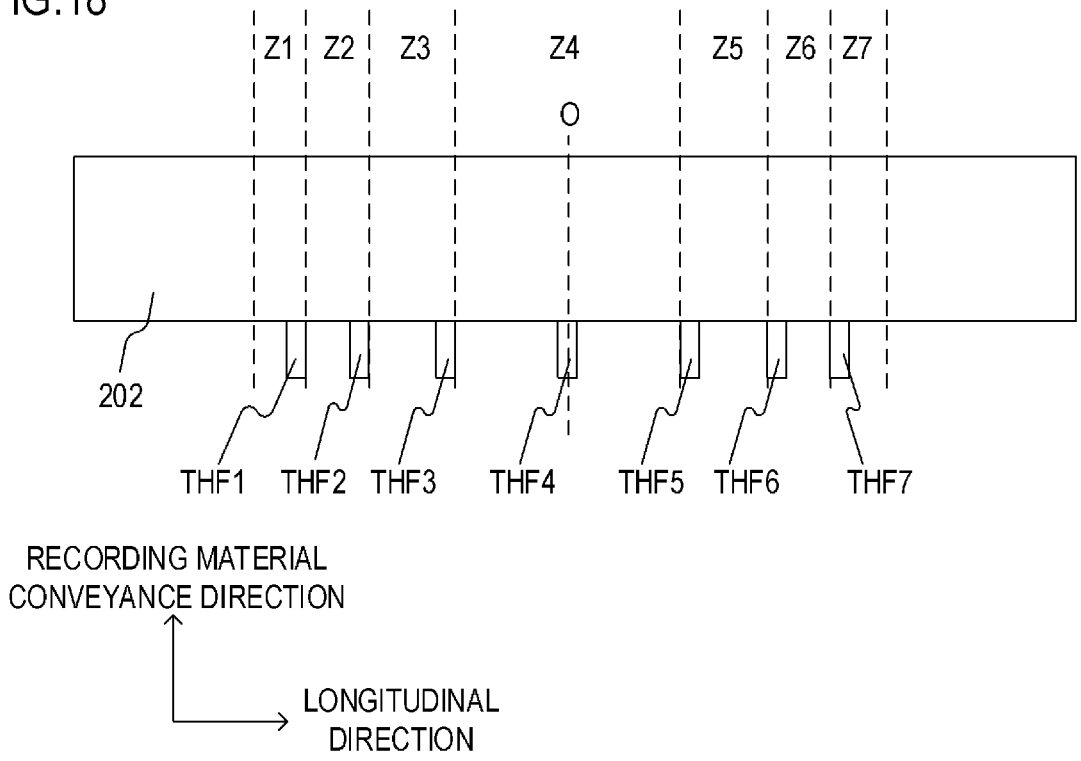
FIG. 18 is an arrangement diagram of the film 202 and thermistors THF1 to THF7 of Embodiment 3.

FIG. 18 shows an arrangement diagram of the film 202 and the thermistors THF1 to THF7 in Embodiment 3 in the longitudinal direction. The thermistors THF1 to THF7 are arranged one by one at positions close to the paper conveyance reference position O in the heating regions Z1 to Z7. The thermistors THF1 to THF7 come into contact with the film 202 to detect the temperature in each heating region of the film 202.

The control circuit 400 controls the heating amount of the film 202 in each heating region by controlling the energization amount of each heating resistor 302-1 to 302-7 on the basis of the detection results of the thermistors THF1 to THF7.

Figure 19:
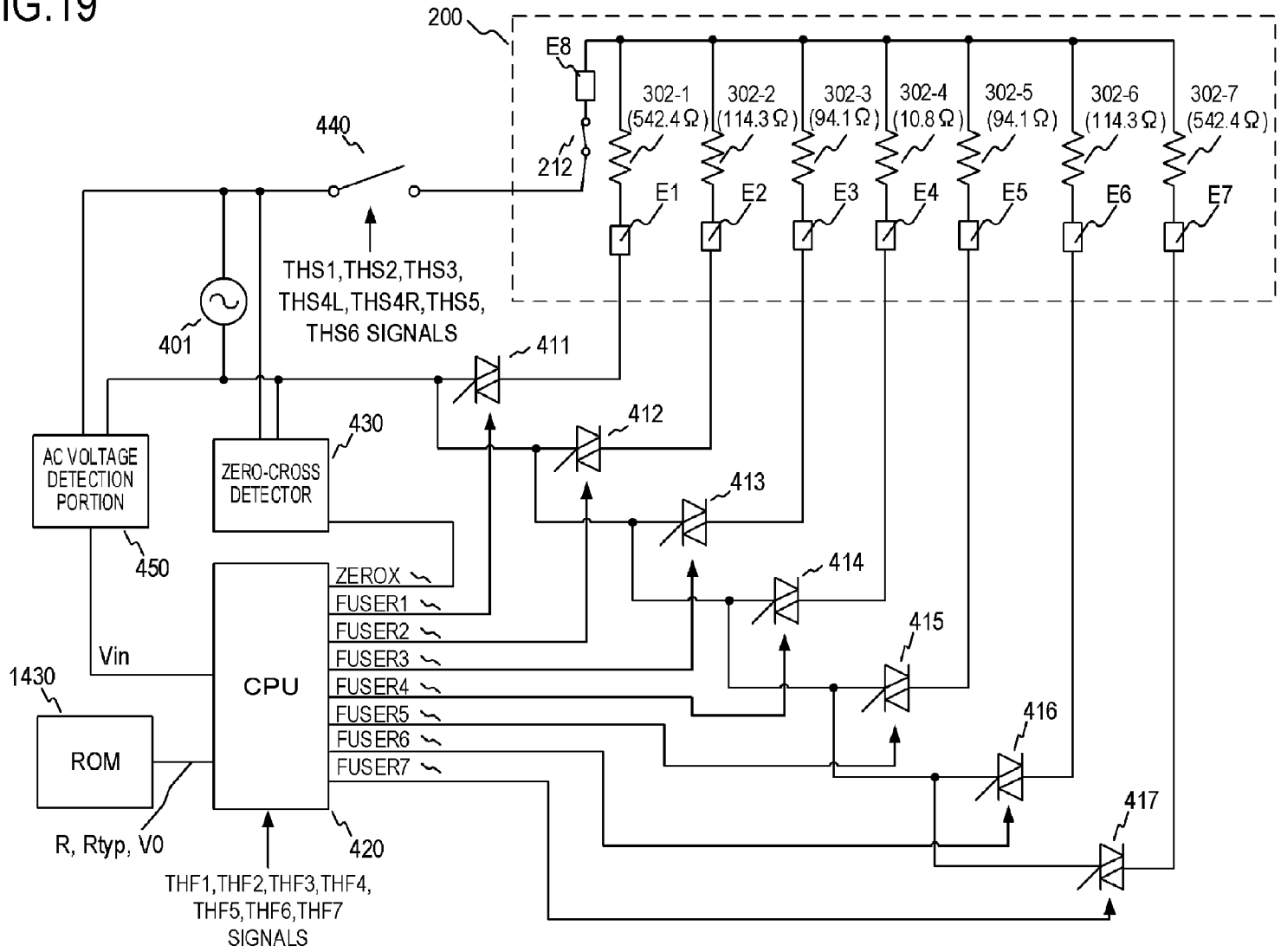
FIG. 19 is a control circuit diagram of Embodiment 3.

FIG. 19 is a control circuit diagram of the control circuit 400 in Embodiment 3. The reference numeral 401 denotes a commercial AC power supply connected to the image forming apparatus 100. The triacs 411 to 417, the zero-cross detector 430, and the relay 440 are the same as those in Embodiment 1, and the description thereof will be omitted.

As for the temperature detected by the thermistor THF1, a voltage divided with a resistor (not shown) is detected by the CPU 420 as a THF1 signal. The detection for the thermistors THF2 to THF7 is performed by the CPU 420 in a similar manner. In the internal processing of the CPU 420, the heating amount Qzi [W/mm] (i=1 to 7) of each heating region is calculated by, for example, PI control on the basis of the detection temperatures of the thermistors THF1 to THF7 and the set temperature of the film 202. The value obtained by multiplying the heating amount Qzi by the width Li [mm] (i=1 to 7) of each heating resistor in the longitudinal direction is calculated as power supply Di [W] (i=1 to 7) to the heating resistors 302-1 to 302-7, respectively. A method for correcting the spread in the voltage of the AC power supply and the resistance values of the heating resistors 302-1 to 302-7 is the same as that in Embodiment 1.

Further, the CPU 420 performs conversion to control levels of a phase angle (phase control) and a wave number (wave number control) corresponding to each of the corrected power supply Dc1 to Dc7 to the heating resistors 302-1 to 302-7, and controls the triacs 411 to 417 by this control condition.

Description of Heating Control of Film 202 in Embodiment 3

Described hereinbelow is heating control of the film 202 while the k-th ($1 \leq k \leq N-1$) recording material to be heated passes through the fixing nip N when the toner images formed on N ($N \geq 2$) recording materials are continuously heated using the fixing device of Embodiment 3. The target temperature in the heating control differs between the case of the paper-passing heating region and the case of the non-paper-passing heating region.

First, in the heating control of the film 202 in the paper-passing heating region, the target temperature is taken as a temperature TA (fixing temperature TA) at which the toner image is sufficiently fixed on the recording material when the unfixed toner image on the recording material P is fixed. When the toner image printed on Letter paper was heated and fixed using the image forming apparatus of Embodiment 3, the temperature of the film 202 at which the toner image was sufficiently fixed on the recording material was 170° C. Therefore, in Embodiment 3, the fixing temperature TA is set to 170° C.

Meanwhile, the temperature control of the film 202 in the non-paper-passing heating region is switched between the first control mode and second control mode according to the distance X, as in Embodiment 1.

The heating amount Q1 in Embodiment 3 is such that the temperature of the film 202 in the non-paper-passing heating region of the k-th recording material is maintained at or above a temperature T1 that makes it possible to reach the fixing temperature TA within the rise time Δt.

When two sheets of Letter paper were continuously passed using the image forming apparatus of Embodiment 3, it was found that the temperature of the film 202 increased by 5° C. within a paper interval of 50 mm (within 0.15 s). Therefore, in Embodiment 3, the temperature T1 is set to 165° C., which is obtained by subtracting 5° C. from TA=170° C.

Further, the heating amount Q2 in Embodiment 3 is a heating amount necessary for controlling the temperature of the film 202 in the non-paper-passing heating region on the k-th sheet to a temperature T2 which is lower than the temperature T1.

Figure 20:
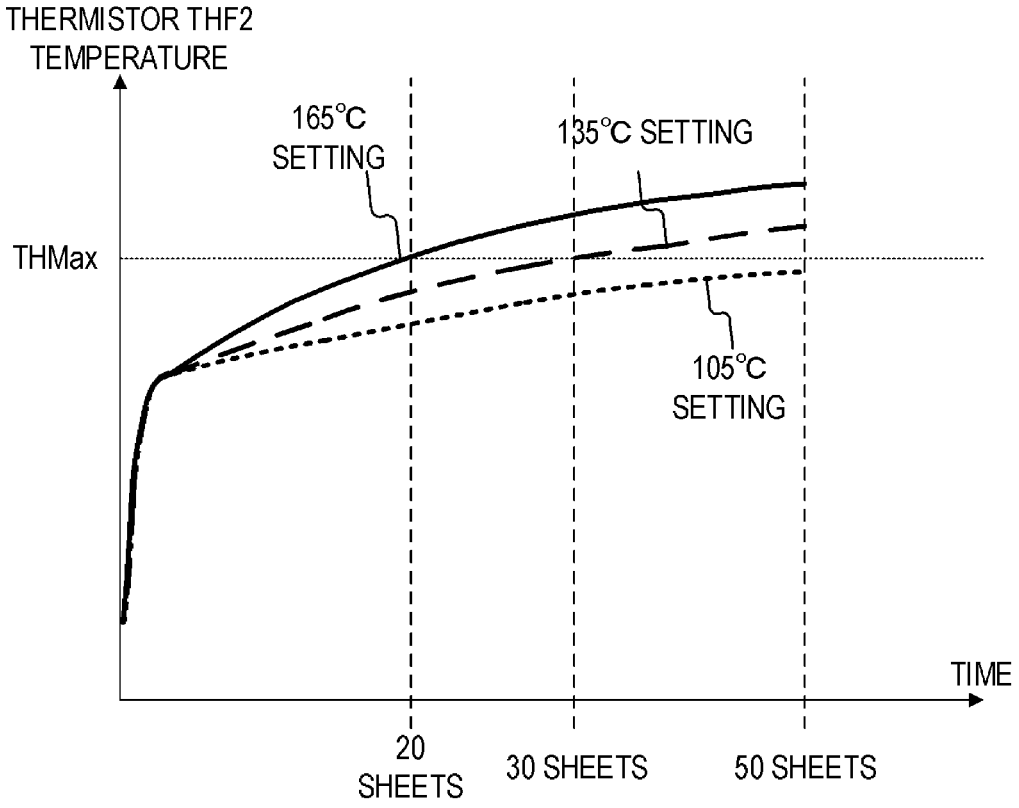
FIG. 20 shows the temperature change of the thermistor THS2 when 16K paper is continuously passed in Embodiment 3.

The temperature T2 will be explained hereinbelow by using FIG. 20. FIG. 20 shows the temperature change of the thermistor THF2 when 50 sheets of 16K paper were continuously passed without reducing the throughput by using the image forming apparatus of Embodiment 3. The solid line, the broken line, and the dotted line show the temperature change when the temperature T2 of the film 202 in the non-paper-passing heating region was set to 165° C., 135° C., and 105° C., respectively. When the temperature T2 of the film 202 in the non-paper-passing heating region was set to 165° C., the temperature of the thermistor THF2 reached THMax (270° C.) at the 20th sheet. When the temperature T2 of the film 202 in the non-paper-passing heating region was set to 135° C., the temperature of the thermistor THF2 reached THMax (270° C.) at the 30th sheet. When the temperature T2 of the film 202 in the non-paper-passing heating region was set to 105° C., the 50th sheet could be continuously passed without the temperature of the thermistor THF2 reaching THMax (270° C.). Therefore, in Embodiment 3, the temperature T2=105° C.

Control Flowchart of Image Heating Device in Embodiment 3

Figure 21:
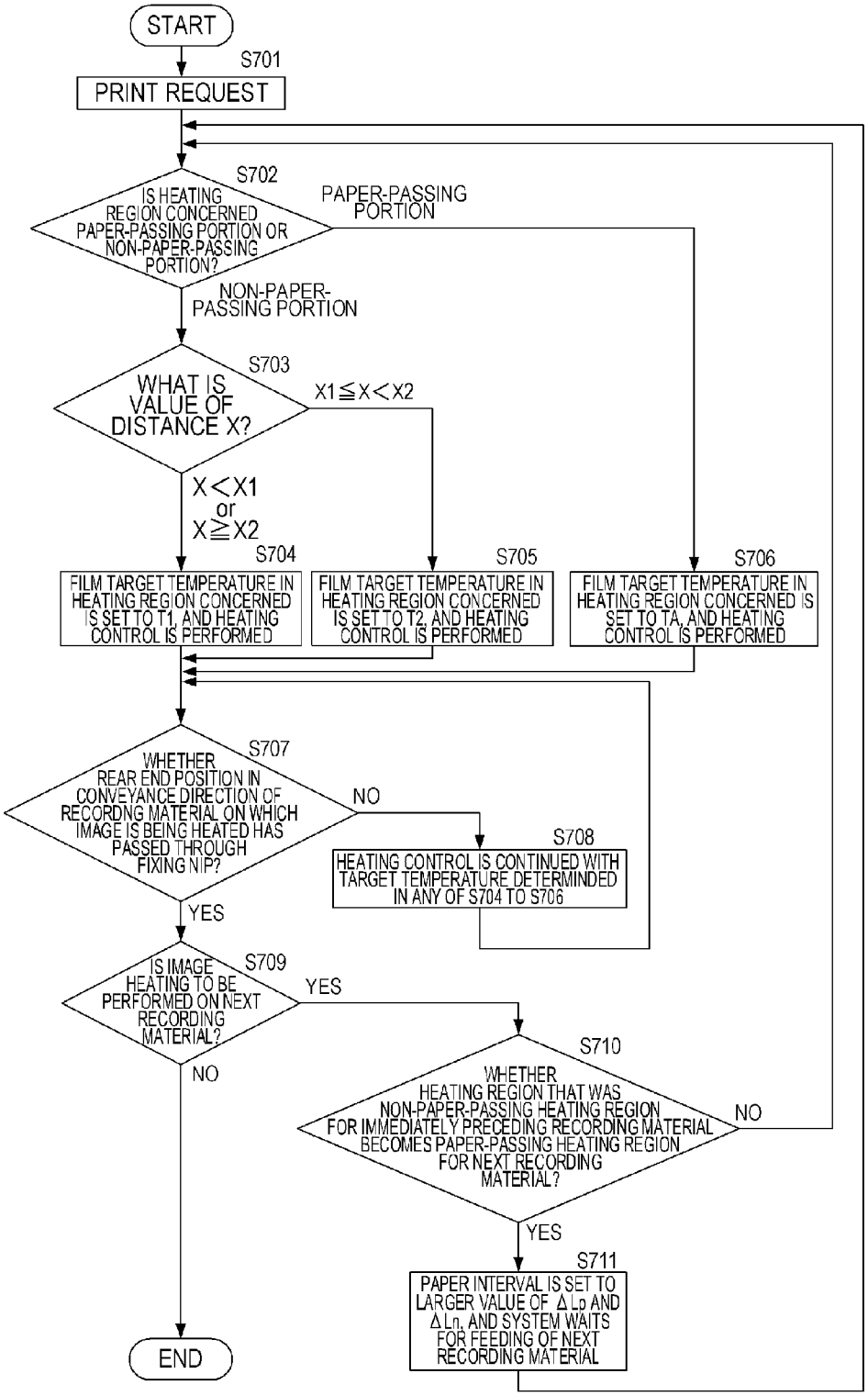
FIG. 21 is a control flowchart of the fixing device according to Embodiment 3.

FIG. 21 is a flowchart illustrating a temperature control sequence of the fixing device 200 by the control circuit 400 when printing on the recording material P in the image forming apparatus according to Embodiment 3. In each of the heating regions Z1 to Z7, determination is independently performed based on this flowchart to perform heating control of the film 202.

When a print request is generated in step S701, the process proceeds to step S702, and whether the heating region concerned is a paper-passing heating region or a non-paper-passing heating region is determined based on the paper width W of the recording material P passing through the fixing nip and Table 2. Where it is determined that the heating region concerned is the non-paper-passing heating region, the process proceeds to S703. Meanwhile, where it is determined that the heating region concerned is the paper-passing heating region, the process proceeds to S706.

In S703, it is determined what is the value of the distance X. Where the distance X is smaller than the threshold X1, or where the distance X is equal to or larger than the threshold X2, the process proceeds to S704. Where the distance X is equal to or larger than the threshold X1 and smaller than the threshold X2, the process proceeds to S705.

In S704, the target temperature of the film 202 in the heating region concerned is set to T1, and heating control is performed.

In S705, the target temperature of the film 202 in the heating region concerned is set to T2, and heating control is performed.

In S706, the target temperature of the film 202 in the heating region concerned is set to TA, and heating control is performed.

In S707, it is determined whether or not the rear end position in the conveyance direction of the recording material P on which an image is being heated has passed through the fixing nip. Where the passage has been completed, the process proceeds to S708, and where the passage has not been completed, the process proceeds to S709.

In S708, the heating control is continued with the target temperature determined in any of S704, S705, and S706, and the process proceeds to S707.

In S709, it is determined whether or not the image heating on the next recording material is to be performed. Where the image heating on the next recording material is to be performed, the process proceeds to S710. Where the image heating on the next recording material is not to be performed, the flow ends.

In S710, it is determined whether or not the heating region that was the non-paper-passing heating region for the recording material that has passed through the fixing nip becomes the paper-passing heating region for the next recording material. Where it becomes the non-paper-passing heating region for the next recording material, the process proceeds to S702. Where it becomes the paper-passing heating region for the next recording material, the process proceeds to S711.

In S711, the paper interval from the recording material that has passed through the fixing nip to the next recording material is set to the larger value of ΔLp and ΔLn, and the system waits for feeding of the next recording material. ΔLp is a paper interval required for raising the temperature of the film 202 in the heating region, which was the non-paper-passing heating region for the recording material that has passed through the fixing nip, to a temperature TA before the time point at which the leading end position in the conveyance direction of the next recording material starts to pass through the fixing nip N. Meanwhile, ΔLn is a paper interval required for lowering the temperature of the film 202 which was the non-paper-passing portion in the recording material that has passed through the fixing nip to a temperature at which the hot offset does not occur before the time point at which the leading end position in the conveyance direction of the next recording material starts to pass through the fixing nip N. Where a time corresponding to the larger one of ΔLp and ΔLn (a value obtained by dividing the paper interval by a process speed of 330 mm/s) has elapsed since the recording material previously subjected to image heating has passed through the fixing nip, the process proceeds to S702, and a transition is made to the image heating operation of the next recording material.

In Embodiment 3, the temperature control of the film 202 in the non-paper-passing heating region is switched between the first control mode and the second control mode according to the distance X between the boundary position V between the paper-passing heating region and the non-paper-passing heating region and the recording material end portion position VP. This makes it possible to reduce the total printing time of the recording material for a small-size/large-size mixed job in the same manner as in Embodiment 1.

In Embodiments 1, 2, and 3, the rise time Δt is defined as a difference in time between a time point at which the rear end position in the conveyance direction of the k-th recording material ends passing through the fixing nip N, and a time point at which the leading end position in the conveyance direction of the next recording material on which the image is to be heated at a minimum paper interval starts to pass through the fixing nip N. However, this definition is not limiting, and the rise time Δt may be a difference in time between any time point while the k-th recording material to be heated passes through the fixing nip N, and any time point while the (k+1)-th recording material to be heated passes through the fixing nip N. For example, the rise time may be a difference in time between a time point at which the image rear end position on the k-th recording material to be heated passes through the fixing nip N, and a time point at which the image leading end on the (k+1)-th recording material to be heated starts to pass through the fixing nip N.

In the effect verification of Embodiment 1, the case where the COM10 envelope and the Letter paper were alternately passed one by one has been described as an example of the small-size/large-size mixed job. However, the effects demonstrated by the present invention are not limited to this case. For example, the use of the present invention can reduce the total printing time in a variety of cases, such as a case where one COM10 envelope, one B5 sheet and one Letter paper are sequentially passed, a case where two A6 sheets and one A4 sheet are alternately passed, and the like.

Other Embodiments

In Embodiments 1, 2, and 3, the recording material is passed on the basis of the central conveyance. However, the same effect can be obtained with a configuration in which the recording material is passed on the basis of one-side conveyance.

The number of divisions of the heating regions (heating resistors) does not necessarily have to be seven. With the central conveyance reference, the same effect can be obtained when the number of divisions is three or more. With the one-sided conveyance reference, the same effect can be obtained when the number of divisions is two or more.

Also, the division positions in the longitudinal direction of the heating regions (heating resistors) does not necessarily need to be those of Embodiments 1, 2, and 3. For example, the same effect can be obtained by setting the width of (the heating resistor 302-4 for heating) the heating region Z4 to 105 mm so as to correspond to the paper width of A6 paper.

In Embodiments 1, 2, and 3, the heating elements having the positive TCR were used. However, the same effect can be obtained with the heating elements having a zero or negative TCR.

The above embodiments can be combined with each other as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-063327, filed on Mar. 28, 2019, which is hereby incorporated by reference herein in its entirety.

What is claimed is:

1. An image heating device comprising:

a heating unit including a heater for heating an image formed on a recording material, wherein the heater includes a substrate and a plurality of heating resistors provided on the substrate so as to be separated in a direction orthogonal to a conveyance direction of the recording material;

a cylindrical film that is in contact with the heating unit by an inner surface thereof;

a pressing member that comes into contact with an outer surface of the film to form a nip portion that conveys the recording material between the outer surface of the film and the pressing member; and a control portion that controls electric power supplied to the plurality of heating resistors, wherein, when a small-size recording material passes the nip portion, a plurality of heating regions in the nip portion heated by the plurality of heating resistors includes a paper-passing heating region through which the recording material passes, and a non-paper-passing heating region through which the recording material does not pass, wherein the control portion has a first control mode in which power is supplied at a first power to a heating resistor among the plurality of heating resistors for heating the paper-passing heating region, and power is supplied at a second power to a heating resistor among the plurality of heating resistors for heating the non-paper-passing heating region, the second power being less than the first power, and a second control mode in which power is supplied at the first power to the heating resistor among the plurality of heating resistors for heating the paper-passing heating region, and power is supplied at a third power to the heating resistor among the plurality of heating resistors for heating the non-paper-passing heating region, the third power being less than the second power, and wherein the control portion switches between the first control mode and the second control mode based on a distance between a boundary position between the paper-passing heating region and the non-paper-passing heating region and a position of a boundary position side end portion of the recording material in the paper-passing heating region in the direction orthogonal to the conveyance direction of the recording material.

2. The image heating device according to claim 1, wherein the control portion controls power in the first control mode in a case where the distance is shorter than a first threshold.

3. The image heating device according to claim 2, wherein the control portion controls power in the second control mode in a case where the distance is longer than the first threshold and shorter than a second threshold which is longer than the first threshold.

4. The image heating device according to claim 3, wherein the control portion controls power in the first control mode in a case where the distance is longer than the second threshold.

5. The image heating device according to claim 1, wherein the device further comprises a temperature detecting element for detecting a temperature of the heater or the film, and wherein the control portion controls power supplied to the plurality of heating resistors so that the temperature detected by the temperature detecting element is maintained at a predetermined control target temperature.

6. An image forming apparatus comprising:

an image forming portion that forms an image on a recording material; and a fixing portion that fixes the image formed on the recording material to the recording material, wherein the fixing portion is an image heating device, wherein the image heating device includes:

a heating unit including a heater for heating an image formed on the recording material, wherein the heater includes a substrate and a plurality of heating resistors provided on the substrate so as to be separated in a direction orthogonal to a conveyance direction of the recording material;

a cylindrical film that is in contact with the heating unit by an inner surface thereof;

a pressing member that comes into contact with an outer surface of the film to form a nip portion that conveys the recording material between the outer surface of the film and the pressing member; and a control portion that controls electric power supplied to the plurality of heating resistors, wherein, when a small size recording material passes the nip portion, a plurality of heating regions in the nip portion heated by the plurality of heating resistors includes a paper-passing heating region through which the recording material passes, and a non-paper-passing heating region through which the recording material does not pass, wherein the control portion has a first control mode in which power is supplied at a first power to a heating resistor among the plurality of heating resistors for heating the paper-passing heating region, and power is supplied at a second power to a heating resistor among the plurality of heating resistors for heating the non-paper-passing heating region, the second power being less than the first power, and a second control mode in which power is supplied at the first power to the heating resistor among the plurality of heating resistors for heating the paper-passing heating region, and power is supplied at a third power to the heating resistor among the plurality of heating resistors for heating the non-paper-passing heating region, the third power being less than the second power, and wherein the control portion switches between the first control mode and the second control mode based on a distance between a boundary position between the paper-passing heating region and the non-paper-passing heating region and a position of a boundary position side end portion of the recording material in the paper-passing heating region in the direction orthogonal to the conveyance direction of the recording material.

* * * * *